US012304692B1

(12) United States Patent
Zhai

(10) Patent No.: US 12,304,692 B1
(45) Date of Patent: May 20, 2025

(54) STORAGE BOX

(71) Applicant: JINGNING MEIGE TECHNOLOGY SERVICE CO., LTD., Lishui (CN)

(72) Inventor: Yifan Zhai, Xiangyang (CN)

(73) Assignee: JINGNING MEIGE TECHNOLOGY SERVICE CO., LTD., Lishui (CN)

( * ) Notice: Subject to any disclaimer, the term of this patent is extended or adjusted under 35 U.S.C. 154(b) by 0 days.

(21) Appl. No.: 18/805,765

(22) Filed: Aug. 15, 2024

(51) Int. Cl.

| | |
|---|---|
| ***B65D 6/18*** | (2006.01) |
| ***B65D 8/00*** | (2006.01) |
| ***B65D 25/06*** | (2006.01) |
| *B65D 6/24* | (2006.01) |

(52) U.S. Cl.
CPC ..... *B65D 15/24* (2013.01); *B65D 15/22* (2013.01); *B65D 25/06* (2013.01); *B65D 11/1866* (2013.01); *B65D 11/1873* (2013.01)

(58) Field of Classification Search
CPC ..... B65D 11/1873; B65D 25/04
See application file for complete search history.

(56) References Cited

U.S. PATENT DOCUMENTS

| | | | | |
|---|---|---|---|---|
| 3,581,906 | A * | 6/1971 | Joyce | A47B 87/0269 211/126.5 |
| 4,673,087 | A * | 6/1987 | Webb | B65D 11/1873 206/508 |
| 6,055,713 | A * | 5/2000 | Genei | B65D 19/18 220/678 |
| 7,896,182 | B1 * | 3/2011 | Hansen | B65D 11/1873 220/4.31 |
| 8,443,496 | B2 * | 5/2013 | De La Fuente | A61G 17/0136 27/27 |
| 2004/0129699 | A1 * | 7/2004 | Williams | B65D 11/1873 220/4.31 |
| 2010/0025397 | A1 * | 2/2010 | Krohn | B65D 88/522 220/6 |

* cited by examiner

*Primary Examiner* — Stephen J Castellano
(74) *Attorney, Agent, or Firm* — Daniel M. Cohn

(57) ABSTRACT

A storage box is provided. The storage box includes a bottom plate, a top plate, two side plates, a front plate, and a rear plate. The bottom plate, the top plate, the two side plates, the front plate, and the rear plate are detachably connected to each other. The bottom plate and the top plate are disposed in parallel in a height direction of the storage box, the two side plates, the front plate, and the rear plate are disposed between the bottom plate and the top plate to enclose to form a storage space. First clamping structures are respectively disposed at two opposite sides of each of the two side plates, and second clamping structures are respectively disposed at two opposite sides of each of the front plate and the rear plate.

20 Claims, 18 Drawing Sheets

STORAGE BOX

TECHNICAL FIELD

The present disclosure relates to a technical field of storage boxes, and in particular to a storage box.

BACKGROUND

Nowadays, storage boxes are widely used in mechanical and electronic industries mainly for storing items, which are convenient in cleaning, efficient in part turnover, tidy in stacking, and easy in managing. The storage boxes are widely applicable in various logistics processes, such as transportation, storage, and processing due to well-designed structure and superior quality.

However, in the prior art, various modules of modular storage boxes are generally connected through a plurality of hooks and corresponding clamping grooves, which easily lead to poor stability in assembly of the modular storage boxes, and especially in a large size storage box, the large size storage box is prone to collapse.

SUMMARY

Embodiments of the present disclosure provides a storage box, which is capable of improving connection stability thereof.

The embodiments of the present disclosure provide the storage box, including a bottom plate, a top plate, two side plates, a front plate, and a rear plate. The bottom plate, the top plate, the two side plates, the front plate, and the rear plate are detachably connected to each other. The bottom plate and the top plate are disposed in parallel in a height direction of the storage box, the two side plates, the front plate, and the rear plate are disposed between the bottom plate and the top plate to enclose to form a storage space. First clamping structures are respectively disposed at two opposite sides of each of the two side plates, and second clamping structures are respectively disposed at two opposite sides of each of the front plate and the rear plate. The first clamping structures and the second clamping structures all extend in the height direction of the storage box, the first clamping structures are respectively clamped with the second clamping structures to fix the two side plates with respect to the front plate and the rear plate.

According to the storage box of the embodiments of the present disclosure, when assembling the storage box, the first clamping structures are respectively clamped at the two opposite sides of each of the two side plates without additional tools, which is simple in assembly manner. Moreover, the first clamping structures and the second clamping structures all extend in the height direction of the storage box, in this way, connection stability between the two side plates, the front plate, and the rear plate are improved.

BRIEF DESCRIPTION OF DRAWINGS

In order to more clearly illustrate embodiments of the present disclosure or technical solutions in the prior art, accompanying drawings required in the embodiments or the prior art are briefly introduced below, and obviously, the accompanying drawings in following description are merely some embodiments of the present disclosure, and for those who skilled in the art, other drawings may also be obtained according to structures shown in the accompanying drawings without creative efforts.

Figure 1:
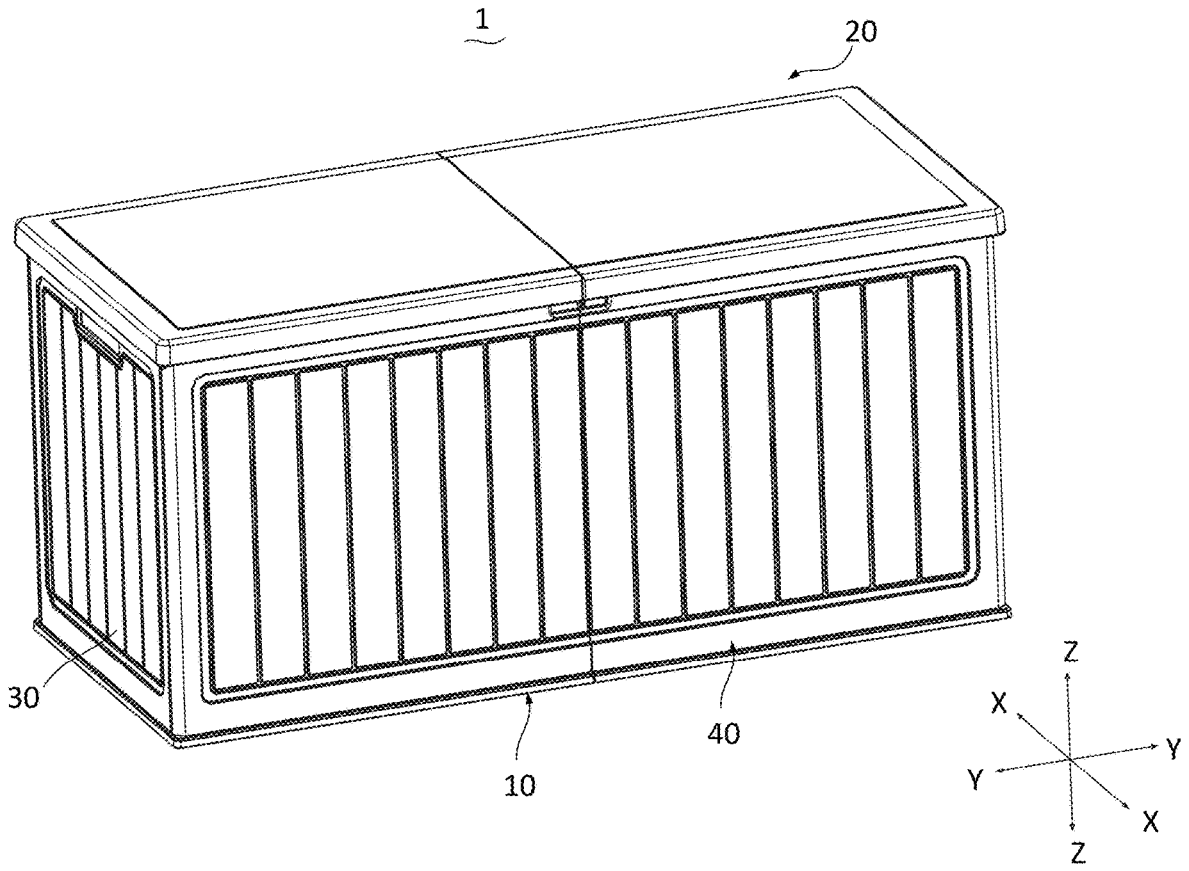
FIG. 1 is a structural schematic diagram of a storage box according to one embodiment of the present disclosure.

Reference numerals in the drawings: 1. storage box; 10. bottom plate; 10*a*. first bottom plate; 10*b*. second bottom plate; 11. first buckling groove; 12. first clamping portion; 13. third buckling groove; 14. second clamping portion; 15. hooking groove; 16. fifth assembling portion; 17. sixth assembling portion; 110. second fixing frame; 20. top plate; 20*a*. first top plate; 20*b*. second top plate; 210. first fixing frame; 23. seventh assembling portion; 24. eighth assembling portion; 30. side plates; 310. first clamping structure; 310*a*. third clamping protrusion; 310*b*. edge portion; 311. first clamping groove; 312. second clamping groove; 320. first limiting portion; 330. first buckling structure; 331. first base portion; 332. first hook portion; 40. front plate; 40*a*. first front plate; 40*b*. second front plate; 41. second clamping structure; 41*a*. fourth clamping groove; 411. third clamping groove; 412. first clamping protrusion; 413. second clamping protrusion; 42. second buckling structure; 421. second base portion; 422. second buckling groove; 423. second hook portion; 43. first assembling portion; 44. second assembling portion; 45. first limiting groove; 50. rear plate; 50*a*. first rear plate; 50*b*. second rear plate; 51. third assembling portion; 52. fourth assembling portion; 60. assembling component; 70. rotating assembly; 71. first connecting component; 72. second connecting component; 73. rotating shaft; 80. locking structure; 81. third connecting component; 82. fourth connecting component; 91. blocking plate; 92. fixing assembly; 921. first fixing component; 9211. first fixing portion; 9212. second fixing portion; 9213. third fixing portion; 9214. first fixing hole; 922. first fixing component; 9221. fourth fixing portion; 9222. fifth fixing portion; 9223. second fixing hole.

Implementations, functional features, and advantages of the present disclosure are further described with reference to the accompanying drawings in combination with the embodiments.

DETAILED DESCRIPTION OF EMBODIMENTS

In order to better understand technical solutions of the present disclosure, embodiments of the present disclosure are described in detail below with reference to accompanying drawings.

When following description refers to the accompanying drawings, unless otherwise indicated, the same numbers in different drawings represent the same or similar elements. Implementations described in following exemplary embodiments do not represent all implementations consistent with the present disclosure. Instead, they are merely examples of apparatuses and methods consistent with some aspects of the present disclosure as recited in appended claims.

In the description of the present disclosure, it should be understood that terms "first", "second", etc. are only used for descriptive purposes, and cannot be understood as indicating or implying relative importance. Those who skilled in the art would understand specific meanings of the foregoing terms in the present disclosure according to specific situations. In addition, in the description of the present disclosure, unless otherwise stated, "a plurality of" means two or more, "and/or" used herein is merely an association relationship describing associated objects. For example, A and/or B may indicate three cases that A exists alone, A and B exist, and B exists alone, and a character "/" in the specification generally indicates an "or" relationship between the associated objects Unless otherwise defined, all technical and scientific terms used herein have the same meaning as commonly understood by those who skilled in the art to which the present disclosure belongs. The terms used in the specification are only for the purpose of describing specific embodiments, and are not intended to limit the present disclosure. As used herein, the term "and/or" includes any and all combinations of one or more of associated listed items.

The embodiments of the present disclosure provide a storage box 1, including a bottom plate 10, a top plate 20, two side plates 30, a front plate 40, and a rear plate 50. The bottom plate 10, the top plate 20, the two side plates 30, the front plate 40, and the rear plate 50 are detachably connected to each other.

In a coordinate system shown in FIG. 1, a height direction of the storage box 1 is defined as Z-Z, a length direction of the storage box 1 is defined as Y-Y, and a width direction of the storage box 1 is defined as X-X. The height direction Z-Z of the storage box 1, the length direction Y-Y of the storage box 1, and the width direction X-X of the storage box 1 are perpendicular to each other.

Figure 2:
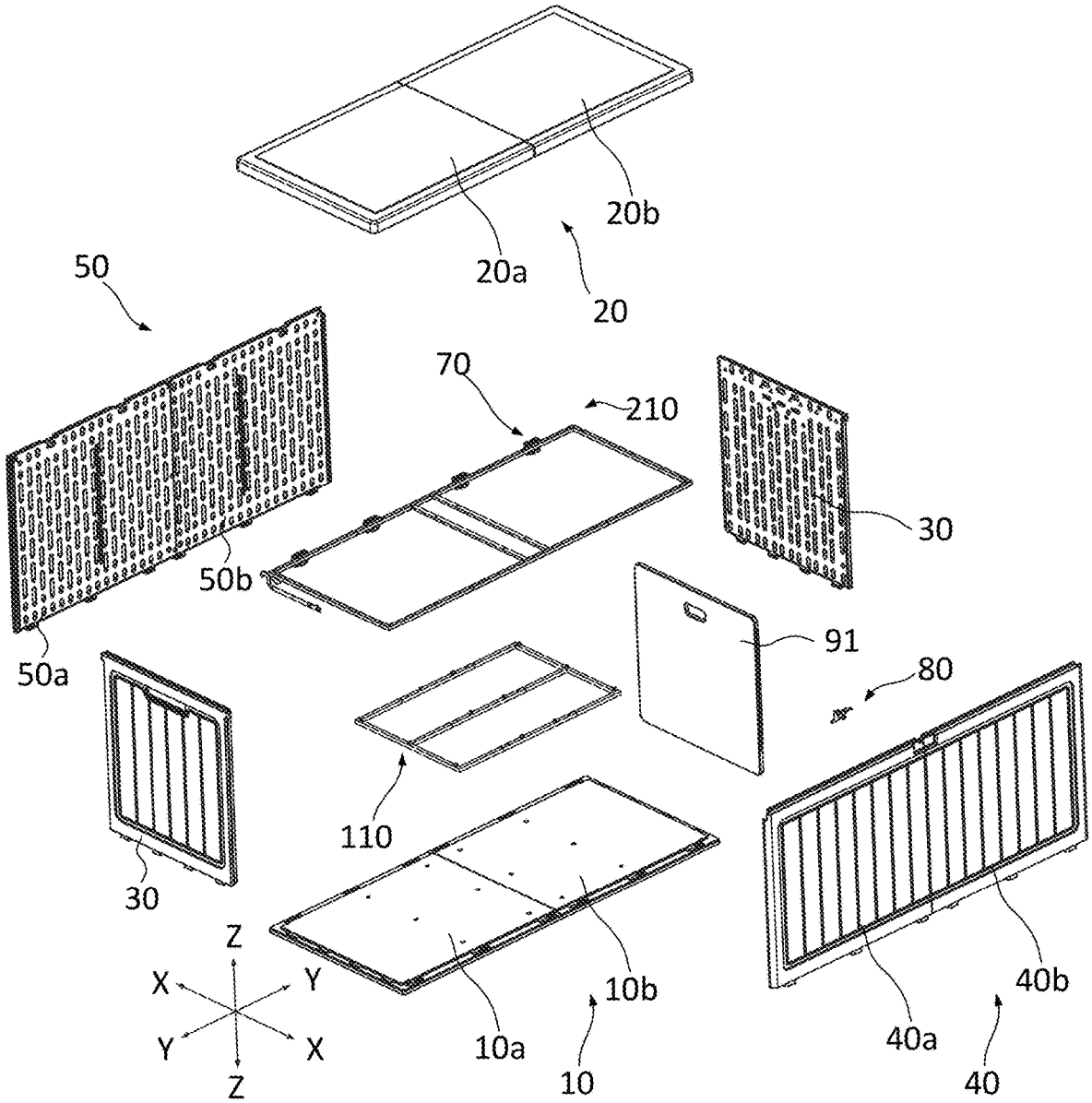
FIG. 2 is a first exploded schematic diagram of the storage box according to one embodiment of the present disclosure.
Figure 3:
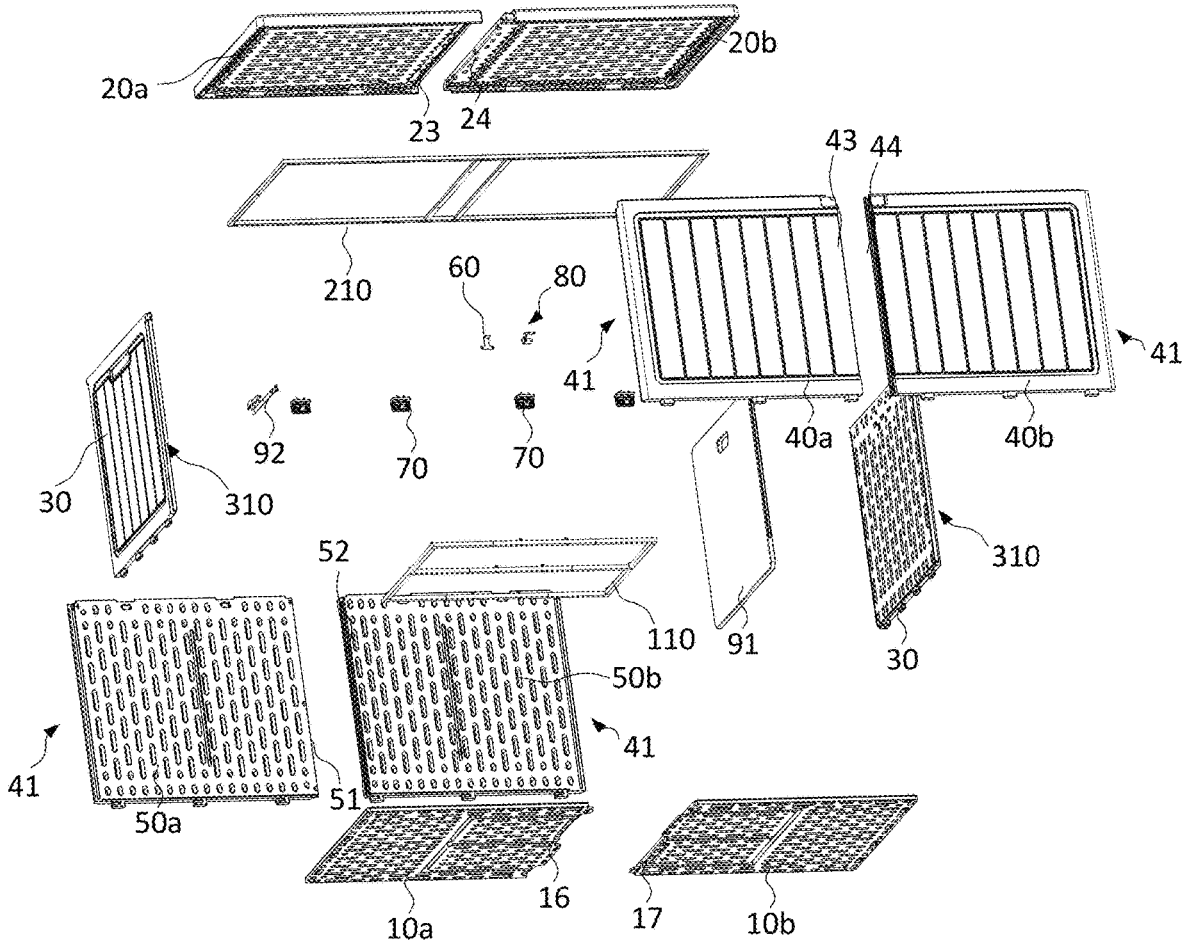
FIG. 3 is a second exploded schematic diagram of the storage box according to one embodiment of the present disclosure.

Please refer to FIGS. 1-3, the bottom plate 10 and the top plate 20 are disposed in parallel in the height direction Z-Z of the storage box 1, the two side plates are disposed in parallel in the width direction X-X of the storage box 1, the front plate 40 and the rear plate 50 are disposed in parallel in the length direction Y-Y of the storage box 1. The two side plates 30, the front plate 40, and the rear plate 50 are disposed between the bottom plate 10 and the top plate 20 to enclose to form a storage space.

Please refer to FIGS. 4-7, first clamping structures 310 are respectively disposed at two opposite sides of each of the two side plates 30, and second clamping structures 41 are respectively disposed at two opposite sides of each of the front plate 40 and the rear plate 50. The first clamping structures 310 and the second clamping structures 41 all extend in the height direction Z-Z of the storage box 1, the first clamping structures respectively disposed at the two opposite sides of each of the two side plates 30 are respectively clamped with the second clamping structures respectively disposed at the two opposite sides of each of the front plate 40 and the rear plate 50 to fix the two side plates 30 with respect to the front plate 40 and the rear plate 50.

Specifically, when assembling the storage box 1, the first clamping structures 310 are respectively clamped at the two opposite sides of each of the two side plates 30 without additional tools, which is simple in assembly manner. Moreover, the first clamping structures 310 and the second clamping structures 41 all extend in the height direction Z-Z of the storage box 1, in this way, connection stability between the two side plates 30, the front plate 40, and the rear plate 50 are improved.

Please refer to FIGS. 4-9 and 20-21, in one embodiment, each of the first clamping structures 310 includes an edge portion 310*a* of a corresponding one of the two side plates 30, a first clamping groove 311, and a second clamping groove 312, each first clamping groove 311 is recessed from an inner side surface of the corresponding one of the two side plates 30, and each second clamping groove 312 is recessed from an outer side surface of the corresponding one of the two side plates 30. Each of the second clamping structures 41 include a third clamping groove 411, a first clamping protrusion 412, and a second clamping protrusion 413, each third clamping groove 411 is recessed from an inner side surface of a corresponding one of the front plate 40 and the rear plate 50, and each first clamping protrusion 412 and each second clamping protrusion 413 are disposed in a corresponding third clamping groove 411. Each first clamping groove 311, each second clamping groove, each first clamping protrusion 412, and each clamping protrusion 413 extend in the height direction Z-Z of the storage box 1.

Specifically, when assembling the two side plates 30 with the front plate 40 and the rear plate 50, the front plate 40 and the rear plate 50 are first fixed on the bottom plate 10, and then the edge portion 310*b* of the corresponding one of the two side plates 30 is inserted into a corresponding third clamping groove 411, meanwhile, each clamping protrusion 412 is inserted into a corresponding first clamping groove 311, and each second clamping protrusion 413 is inserted into a corresponding second clamping groove 312. In this way, the first clamping structures 310 and the second clamping structure 41 are capable of fixing the front plate 40, the rear plate 50, and the two side plates 30 respectively in the height direction Y-Y of the storage box 1 and the width direction X-X of the storage box 1. In the present disclosure, the first clamping structures 310 are respectively recessed from inner side surfaces of the two side plates, and the second clamping structures 41 are respectively recessed from inner side surfaces of the front plate 40 and the rear plate 50, in this way, there is no protruding structure formed on the two side plates 30, the front plate 40, and the rear plate 40, which is beneficial for stacking, transportation, and storage of each plate, and such clamping structures are not prone to being damaged by external force.

Furthermore, each first clamping groove 311 is aligned with a corresponding second clamping groove 312 in the length direction Y-Y of the storage box 1, each first clamping protrusion 412 is aligned with a corresponding second clamping protrusion 413 in the length direction Y-Y of the storage box 1. In this way, a cross section of each of the first clamping structures 310 in the height direction Z-Z is substantially in a T shape, and a cross section of each of the second clamping structures 41 in the height direction Z-Z is substantially a T-shaped clamping groove, so that stability of fixing the two side plates 30 with respect to the front plate 40 and the rear plate 50 in the length direction Y-Y of the storage box 1 and the width direction X-X of the storage box 1 is improved, and the first clamping structures 310 and the second clamping structures 41 are prone to respectively align and assemble.

It should be noted that a distance h between each first clamping protrusion 412 and a corresponding second clamping protrusion 413 is smaller than a thickness of each of the two side plates 30. The distance h herein refers to a minimum distance between each first clamping protrusion 412 and the corresponding second clamping protrusion 413 when each first clamping protrusion 412 and the corresponding second clamping protrusion 413 are respectively inserted into a corresponding first clamping groove 311 and a corresponding second clamping groove 312. Specifically, each of the two side plates 30 has a first thickness and a second thickness, the first thickness refers to a thickness of a main body of each of the two side plates 30, and, each first clamping groove 311 is recessed from the inner side surface of the corresponding one of the two side plates 30, and each second clamping groove 312 is recessed from the outer side surface of the corresponding one of the two side plates 30, that is, the second thickness refers to a portion of the corresponding one of the two side plates 30 where the corresponding first clamping groove 311 and the corresponding second clamping groove 312 are defined, the first thickness is greater than the second thickness H, and the distance h between each first clamping protrusion 412 and the corresponding second clamping protrusion 413 is equal to or less than the second thickness H of each of the two side plates 30. It can be understood that each first clamping protrusion 412 and the corresponding second clamping protrusion 413 have a certain deformation capability in a corresponding third clamping groove 411, so that each first clamping protrusion 412 and the corresponding second clamping protrusion 413 are capable of slightly deforming or expanding in a process of respectively inserting the first clamping structures 310 into the second clamping structures 41 to more tightly clamp the two side plates 30, in this way, the two side plates 30 are effectively fixed without additional clamps or screws, and loosening or vibration during assembling is reduced.

Figure 22:
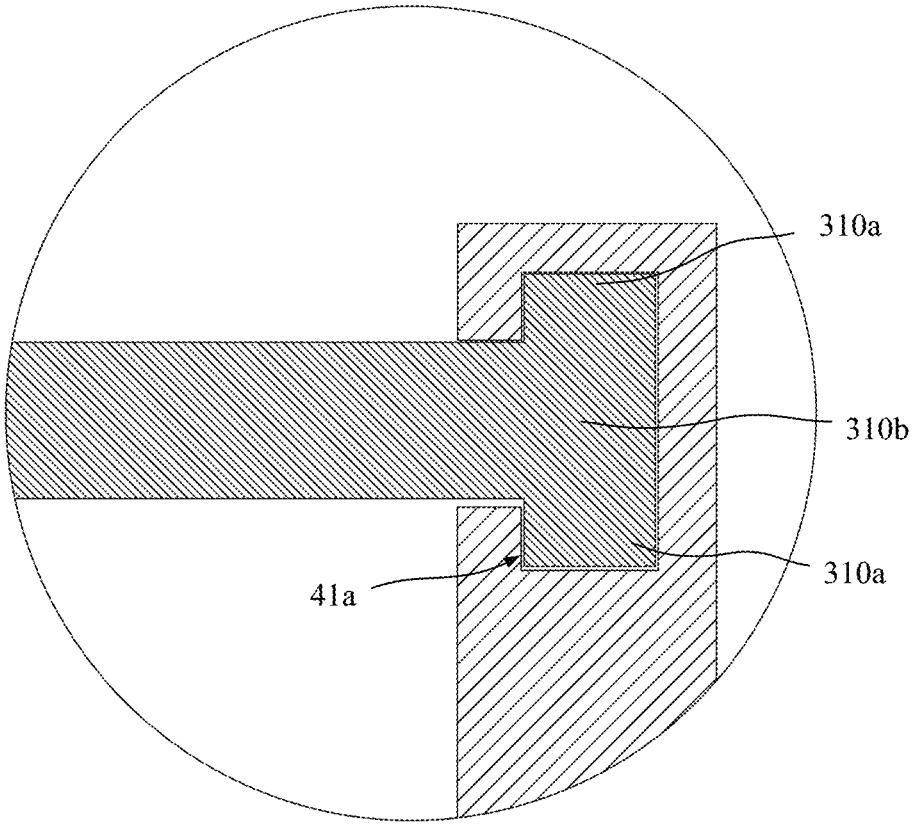
FIG. 22 is another partial cross-sectional schematic diagram of the first clamping structure assembling with the second clamping structure.

Please refer to FIG. 22, in some embodiment, each of the first clamping structures 310 includes at least two third clamping protrusions 310*a*, the at least two third clamping protrusions 310*a* are connected to the edge portion 310*b* of the corresponding one of the two side plates 30 and are disposed at a first included angle. Each of the second clamping structures 41 includes at least two fourth clamping grooves 41*a*, each at least two fourth clamping grooves 41*a* are respectively matched with outer contours of corresponding at least two third clamping protrusions 310*a*, the corresponding at least two third clamping protrusions 310*a* are respectively clamped in corresponding at least two fourth clamping grooves 41*a*. In the embodiment, the at least two third clamping protrusions 310*a* are convexly disposed on an outer surface of each of the two side plates 30, so that a first contact area between each of the two side plates 30 and the front plate 40 and a second contact area between each of the two side plates 30 and the rear plate 50 are increased, thereby improving the connection stability between the two side plates 30, the front plate 40, and the rear plate 50.

Furthermore, each at least two third clamping protrusions 310*a* are respectively connected at two sides of the edge portion 310*b* of the corresponding one of the two side plates 30 in the length direction Y-Y of the storage box 1 and are aligned in the width direction X-X of the storage box 1. In this way, a cross section of the two opposite sides of each of the two side plates 30 in the height direction Z-Z of the storage box 1 is substantially T shape, so that stability of assembling the two side plates 30 with the front plate 40 and the rear plate 50 is improved.

It should be noted that the first clamping structures 310 and the second clamping structures 41 extend in the height direction Z-Z of the storage box 1, and the first clamping structures 310 are configured to match with heights of the two side plates 30, or to be slightly smaller than the heights of the two side plates 30, and the clamping structures 310 continuously extend or extend at intervals, and similarly, the second clamping structures 41 are set with reference to the first clamping structures 310.

Figure 4:
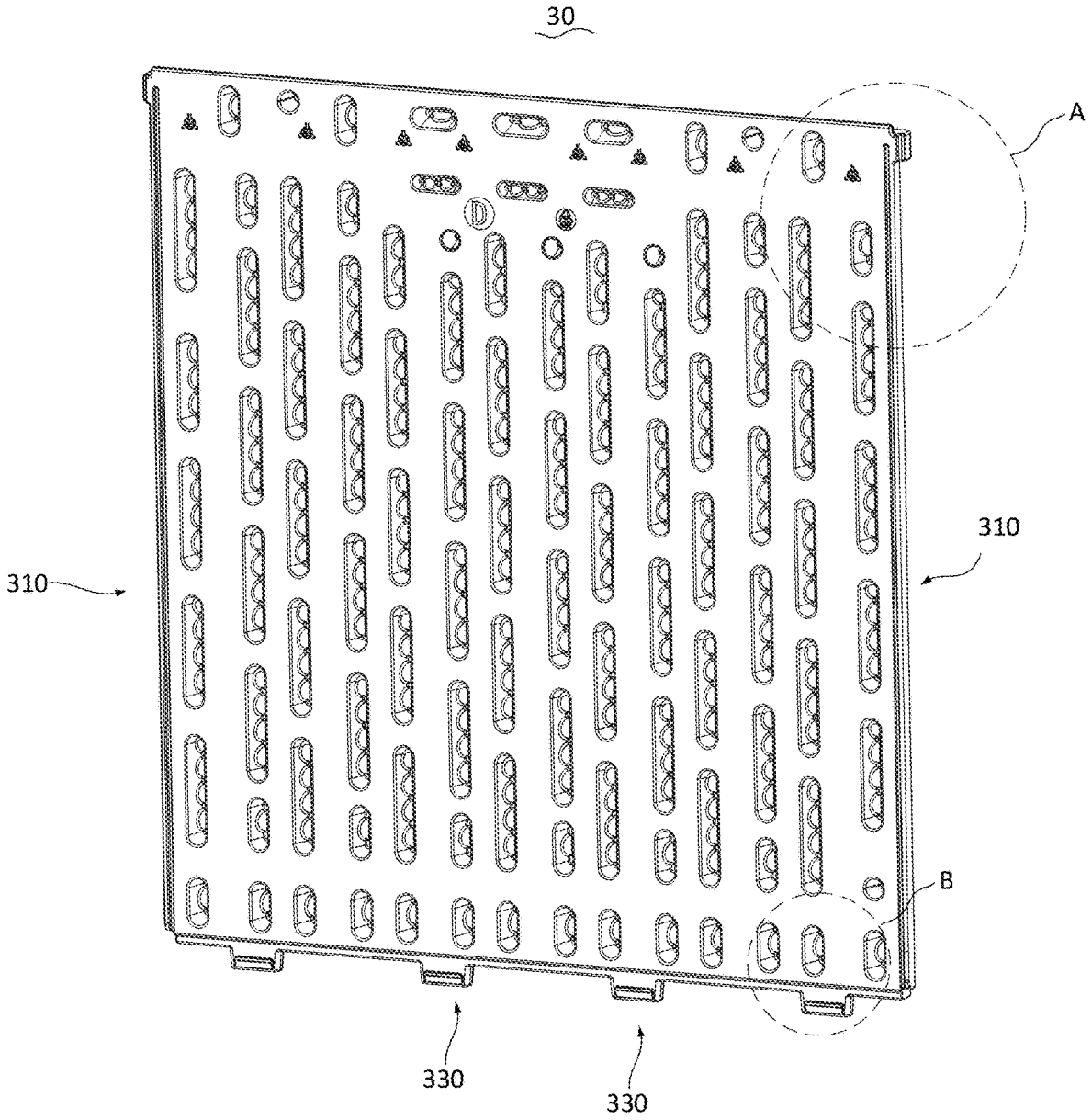
FIG. 4 is a structural schematic diagram of a side plate viewed in a first angle according to one embodiment of the present disclosure.
Figure 5:
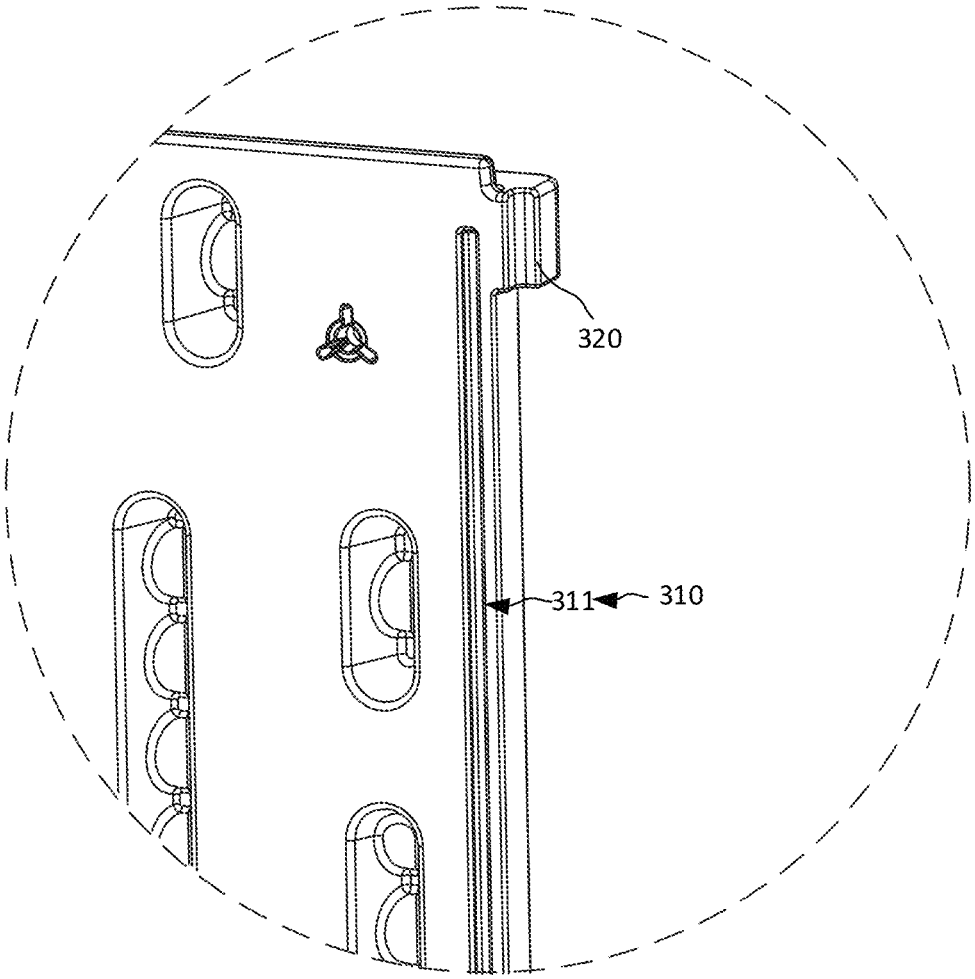
FIG. 5 is a partial enlarged schematic diagram of portion A shown in FIG. 4.
Figure 7:
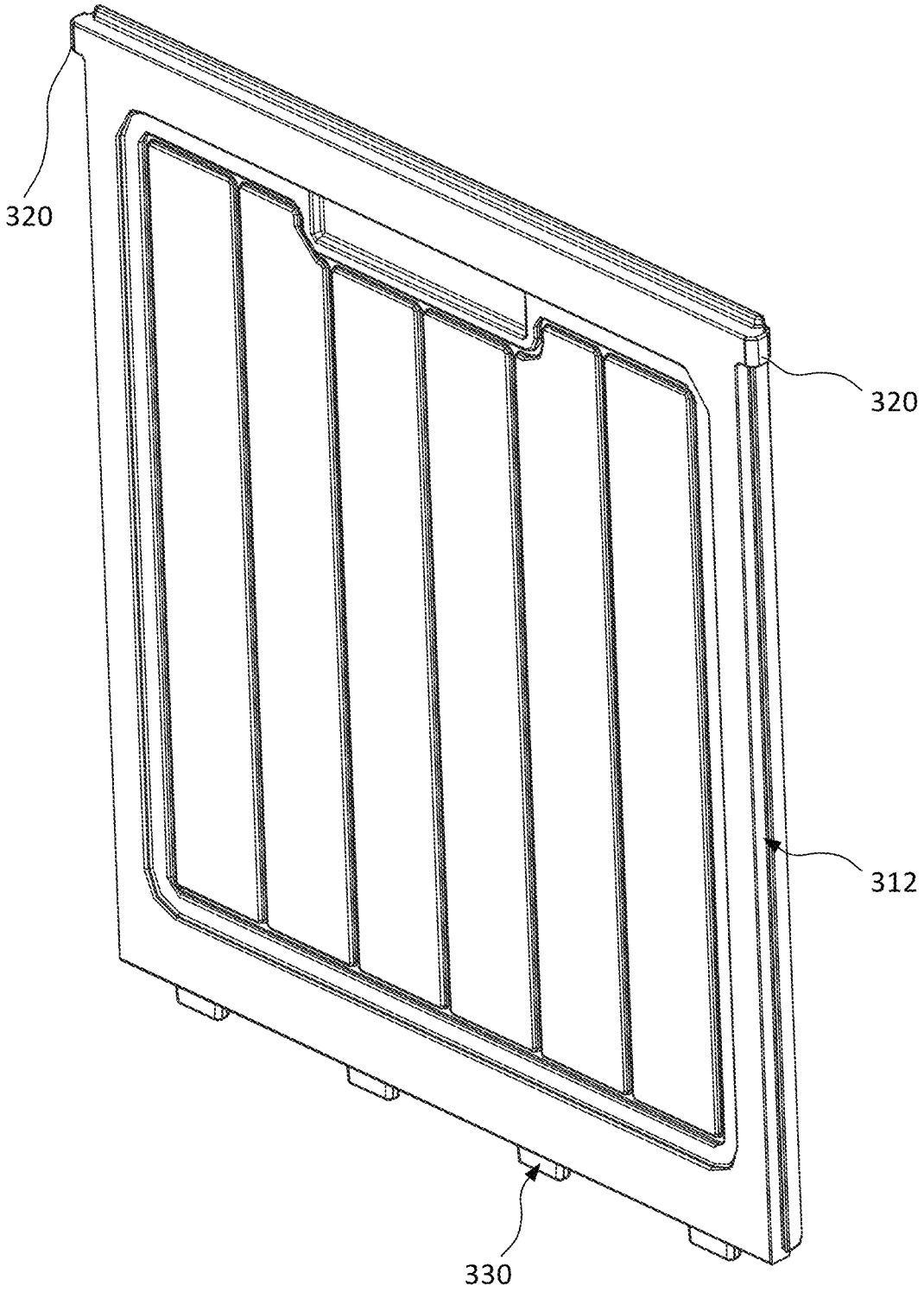
FIG. 7 is a structural schematic diagram of the side plate viewed in a second angle according to one embodiment of the present disclosure.

Please refer to FIGS. 4 and 7, in order to improve the connection stability of the two side plates 30, the front plate 40, and the rear plate 50, each of the two side plates 30 includes a first limiting portion 320 disposed on a top portion of a corresponding one of the first clamping structures 310, each of the front plate 40 and the rear plate 50 includes a first limiting groove 45 defined on a top portion of a corresponding one of the second clamping structures 41. Specifically, after the first clamping structures 310 are respectively inserted into the second clamping structures 41, a pressure is applied to top portions of the two side plates 30, so that the first clamping structures 310 move downwards along an extending direction of the second clamping structures 41, and after moving of the first clamping structures 310, each first limiting portion 320 is embedded in a corresponding first limiting groove 45, and a bottom surface of each first limiting portion 320 abuts against a groove bottom wall of the corresponding first limiting groove 45. In the present disclosure, each first limiting portion 320 and the corresponding first limiting groove 45 directly provide an accurate positioning function, thereby reducing need for additional positioning elements or clamps. In this way, not only is an assembly process simplified, but reduces a number and an assembly cost of parts are also reduced.

Figure 6:
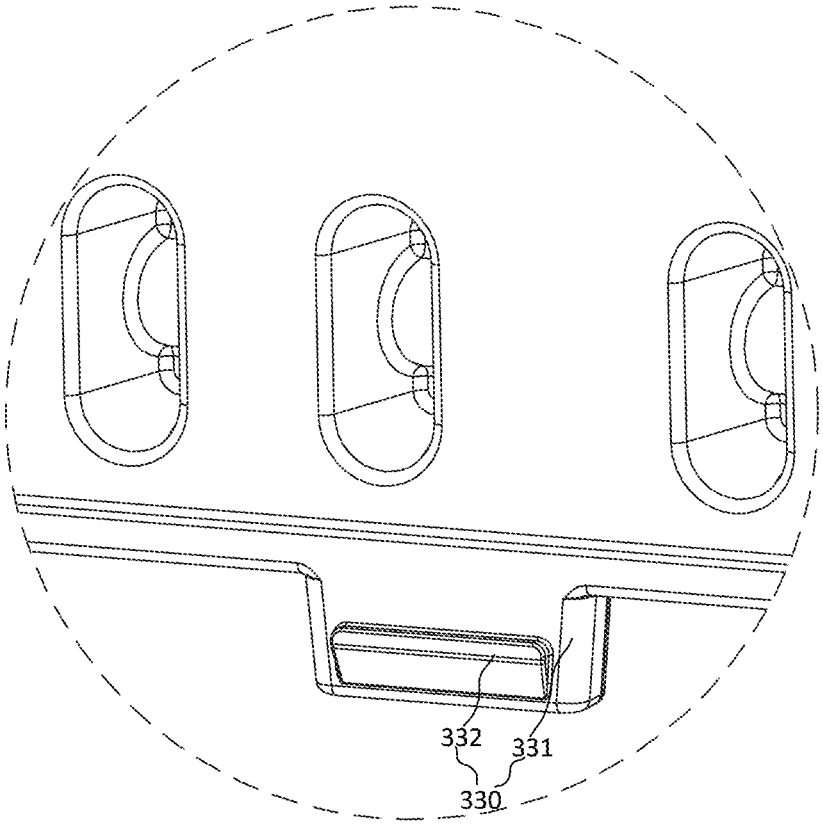
FIG. 6 is a partial enlarged schematic diagram of portion B shown in FIG. 4.

Please refer to FIGS. 4 and 6, in one specific embodiment, each of the two side plates 30 includes at least one first buckling structure 330 disposed at a bottom portion thereof, each at least one first buckling structure 330 includes a first base portion 331 and a first hook portion 332, each first hook portion 332 is connected to one side of a corresponding first base portion 331, specifically, each first hook portion 332 is disposed on an inner side surface of the corresponding first base portion 331 or an outer side surface of the corresponding first base portion 331. The bottom plate 10 includes at least two first buckling grooves 11, each of the at least two first buckling grooves 11 includes a first clamping portion 12 on a groove side wall thereof. Specifically, after the first clamping structures 310 are respectively inserted into the second clamping structures 41, each first base portion 331 is clamped in a corresponding one of the at least two first buckling grooves 11 and each first hook portion 332 is clamped to a corresponding first clamping portion 12. Through such simple inserting and clamping actions, the two side plates 30 are quickly and accurately connected to the bottom plate 10, so that an assembly time and a labor cost are saved. It may be understood that, in one embodiment, one, two, or more first buckle structures 330 are provided corresponding each of the two side plates 30, and one or more second buckling structures 42 may be provided corresponding to each of the front plate 30 and the rear plate 50, and a plurality of first buckling structures 330 and/or a plurality of second buckling structures 42 are provided to dispose at intervals, and the intervals are the same or different, which is not limited in the present disclosure.

Figure 8:
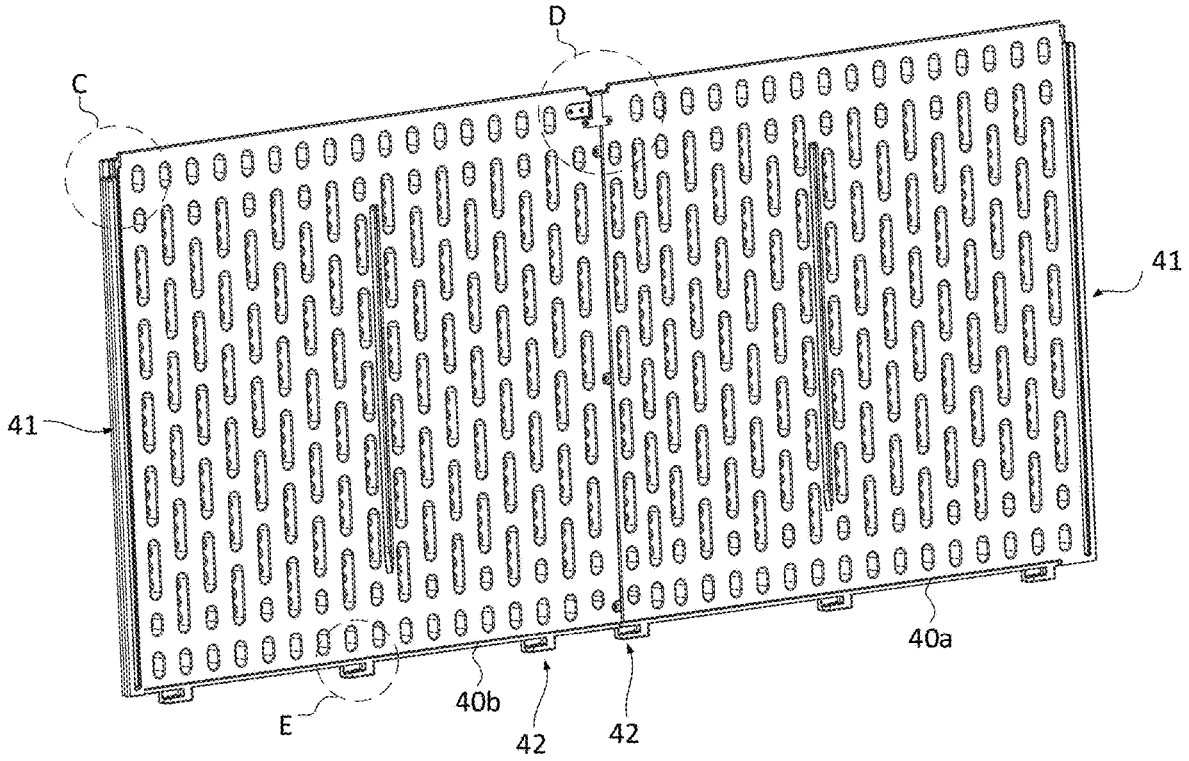
FIG. 8 is a structural schematic diagram of a front plate viewed in a first angle according to one embodiment of the present disclosure.
Figure 9:
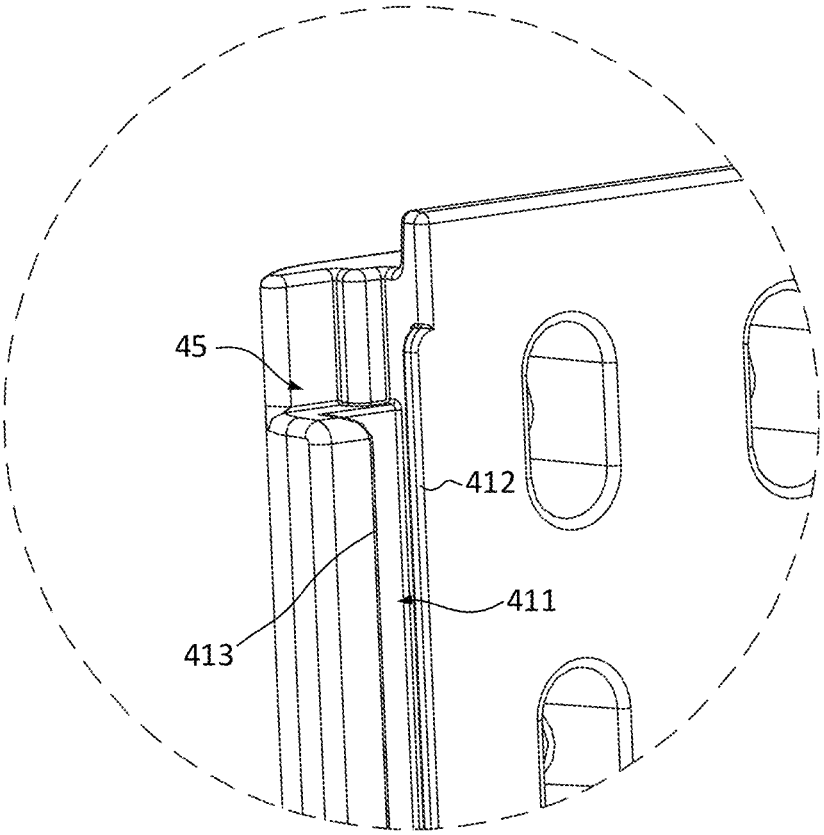
FIG. 9 is a partial enlarged schematic diagram of portion C shown in FIG. 8.

Please refer to FIGS. 3, 8, and 9, in one specific embodiment, each of the front plate 40 and the rear plate 50 includes at least one second buckling structure 42 disposed at a bottom portion thereof, each at least one second buckling structure 42 includes a second base portion 421, each second base portion 421 includes a second buckling groove 422, and a second hook portion 423 is disposed on a groove side wall of each second buckling groove 422. The bottom plate 10 includes at least two third buckling structures, each of the at least two third buckling structures includes a third buckling groove 13 and a second clamping portion 14, each third buckling groove 13 is defined at an edge of the bottom plate 10, each second clamping portion 14 is connected to a groove side wall of a corresponding third buckling groove 13, each second clamping portion 14 includes a hooking groove 15 for matching with a corresponding second hook portion 423. Each second base portion 421 is clamped in the corresponding third buckling groove 13, and each second hook portion 423 is clamped to a corresponding hooking groove 15.

Figure 11:
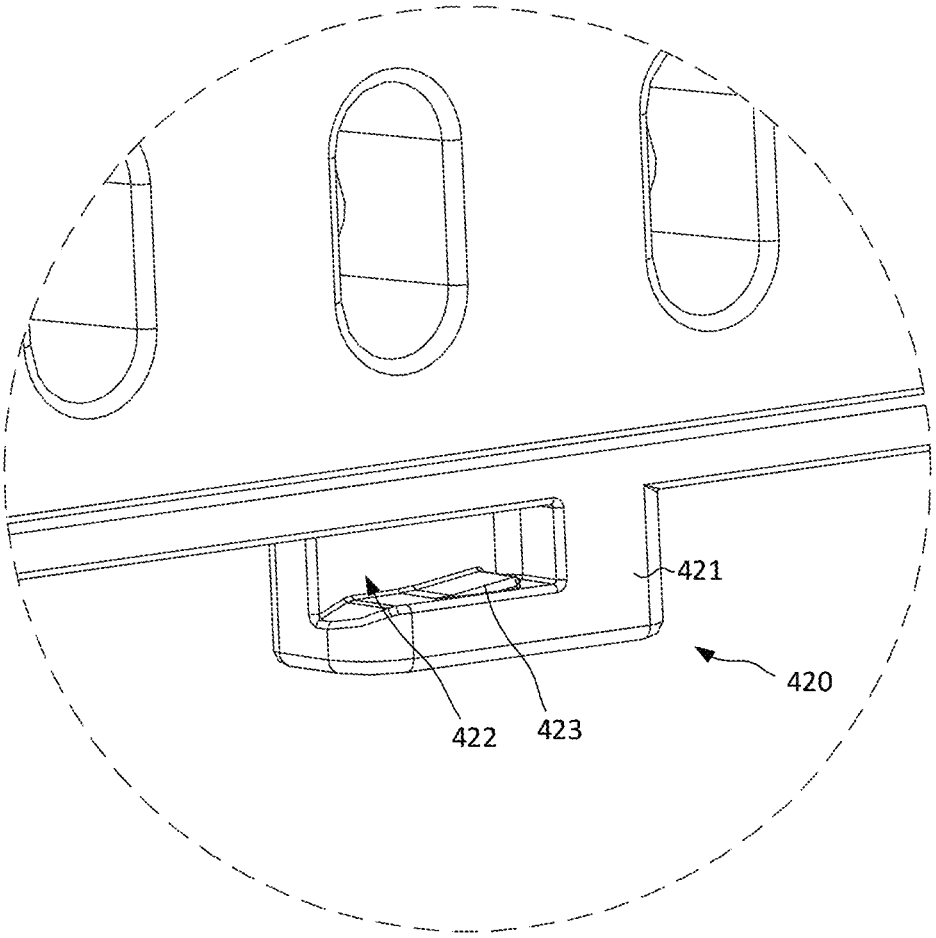
FIG. 11 is a partial enlarged schematic diagram of portion E shown in FIG. 8.
Figure 15:
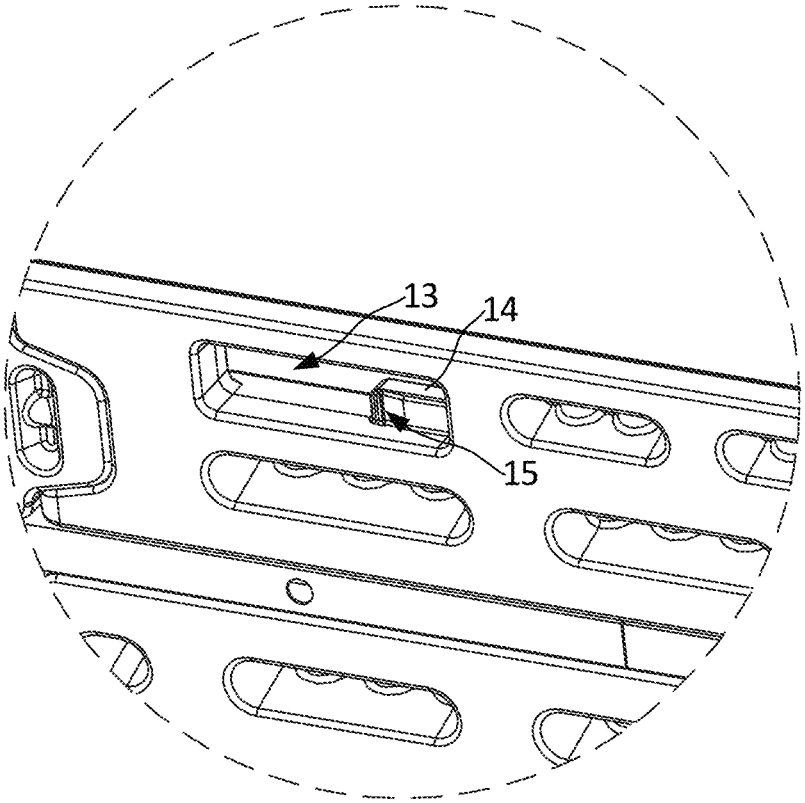
FIG. 15 is a partial enlarged schematic diagram of portion G shown in FIG. 14.
Figure 16:
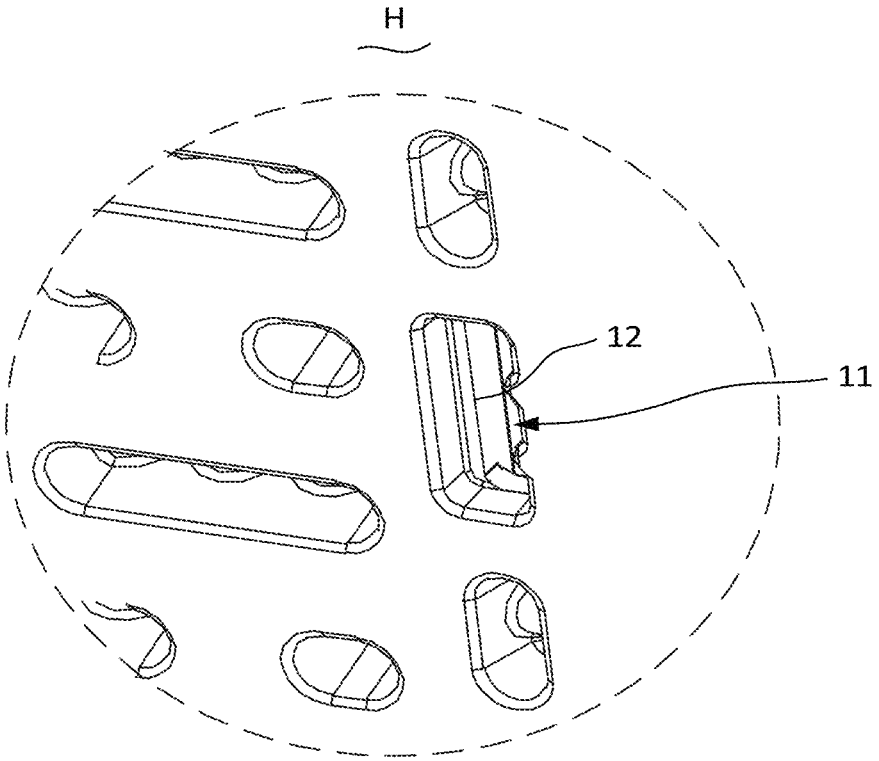
FIG. 16 is a partial enlarged schematic diagram of portion H shown in FIG. 14.
Figure 17:
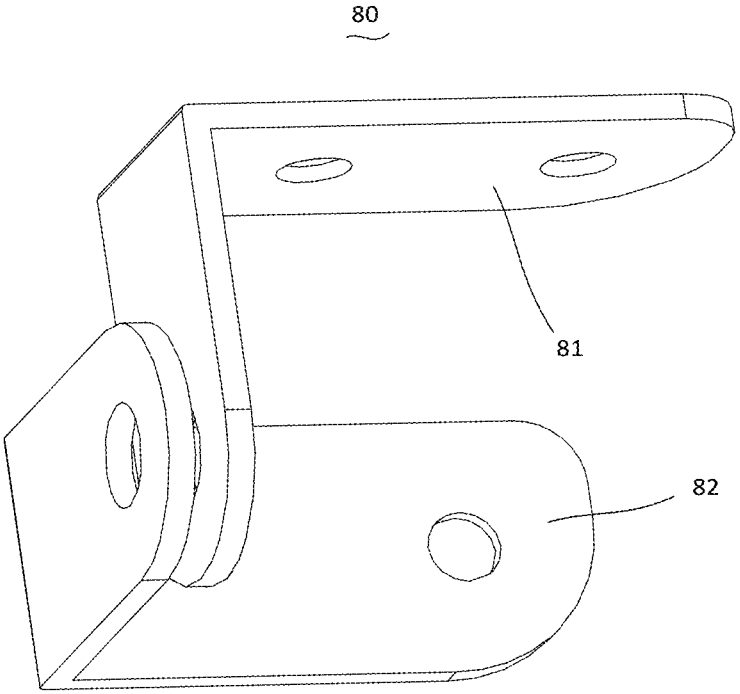
FIG. 17 is a structural schematic diagram of a locking structure according to one embodiment of the present disclosure.

Specifically, please refer to FIGS. 11 and 15, when the front plate 40 and the rear plate 50 are assembled with the bottom plate 10, each second base portion 421 is first inserted into the corresponding third buckling groove 13, and then the front plate 40 and the rear plate 50 are pushed in the length direction Y-Y of the storage box, and at this time, each second base portion 421 laterally moves in the length direction Y-Y of the storage box, and each second clamping portion 14 is clamped to the corresponding second buckling groove 422, at this time, each second hook portion 423 is clamped to the corresponding hooking groove 15. In this way, each at least one second buckling structure 42 is buckled and fixed with a corresponding one of the at least two third buckling structures, so that the front plate 40 and the rear plate 50 are relatively fixed to the bottom plate 10 in the length direction Y-Y of the storage box 1, the width direction X-X of the storage box 1, and the height direction Z-Z of the storage box 1. One or more second buckling structures 42 and one or more third buckling structures may be provided corresponding to each of the front plate 40 and the rear plate 50, which is not limited in the present disclosure.

Please refer to FIGS. 3 and 8, in one specific embodiment, the front plate 40 includes a first front plate 40*a* and a second front plate 40*b*, the first front plate and the second front plate are disposed side by side in the length direction Y-Y of the storage box 1, a first one of the second clamping structures 41 is disposed at a first side of the first front plate 40*a* away from the second front plate 40*b*, and a second one of the second clamping structures 41 is disposed at a first side of the second front plate 40*b* away from the first front plate 40*a*. A first assembling portion 43 is disposed at a second side of the first front plate 40*a* close to the second front plate 40*b*, a second assembling portion 44 is disposed at a second side of the second front plate 40*b* close to the first front plate 40*a*, the first assembling portion 43 is fixed with the second assembling portion 44 to fix the first front plate 40*a* with respect to the second front plate 40*b*.

It should be noted that, in one embodiment, the first assembling portion 43 and the second assembling portion 44 are respectively selected from buckling portions and buckling grooves, each buckling portion and a corresponding buckling groove are fixed into a whole; in another embodiment, the first assembling portion 43 and the second assembling portion 44 are respectively selected from positioning portions and positioning grooves, after each positioning portion is positioned with respect to a corresponding positioning groove, each positioning portion is fixed with respect to the corresponding positioning groove through threaded fasteners, such as bolts and screws. Specific forms and connection forms of the first assembling portion 43 and the second assembling portion 44 are not limited in the present disclosure.

Figure 10:
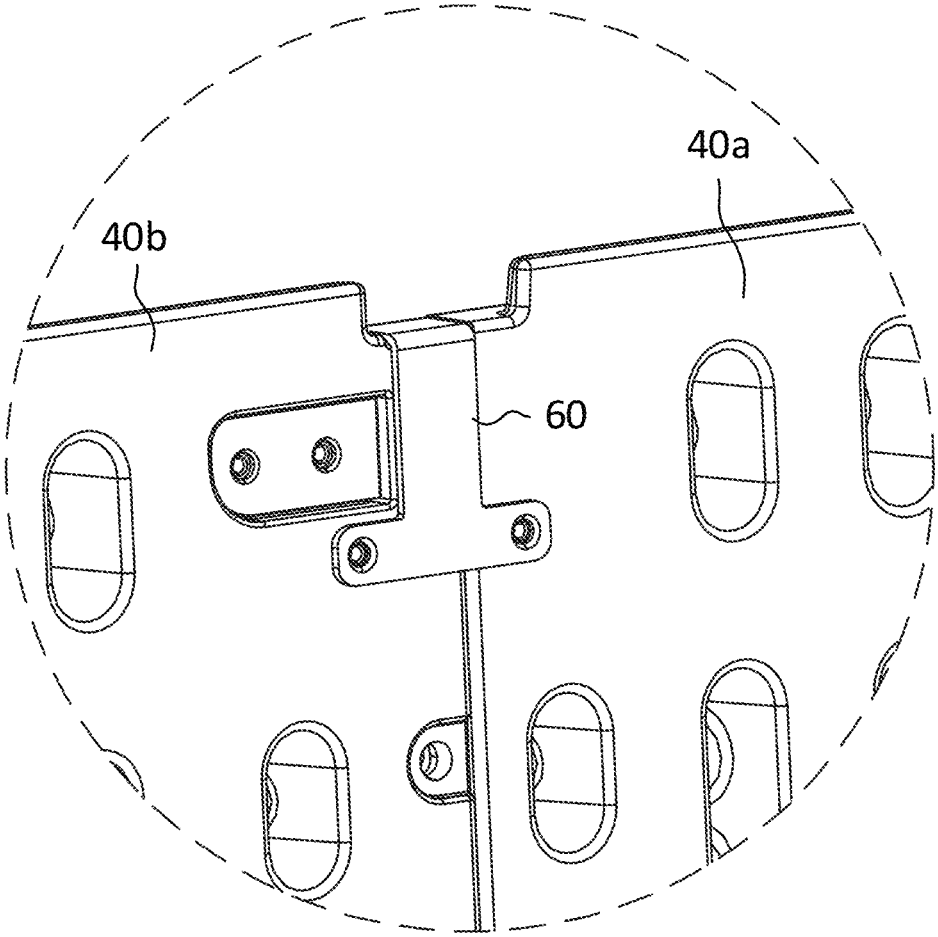
FIG. 10 is a partial enlarged schematic diagram of portion D shown in FIG. 8.
Figure 12:
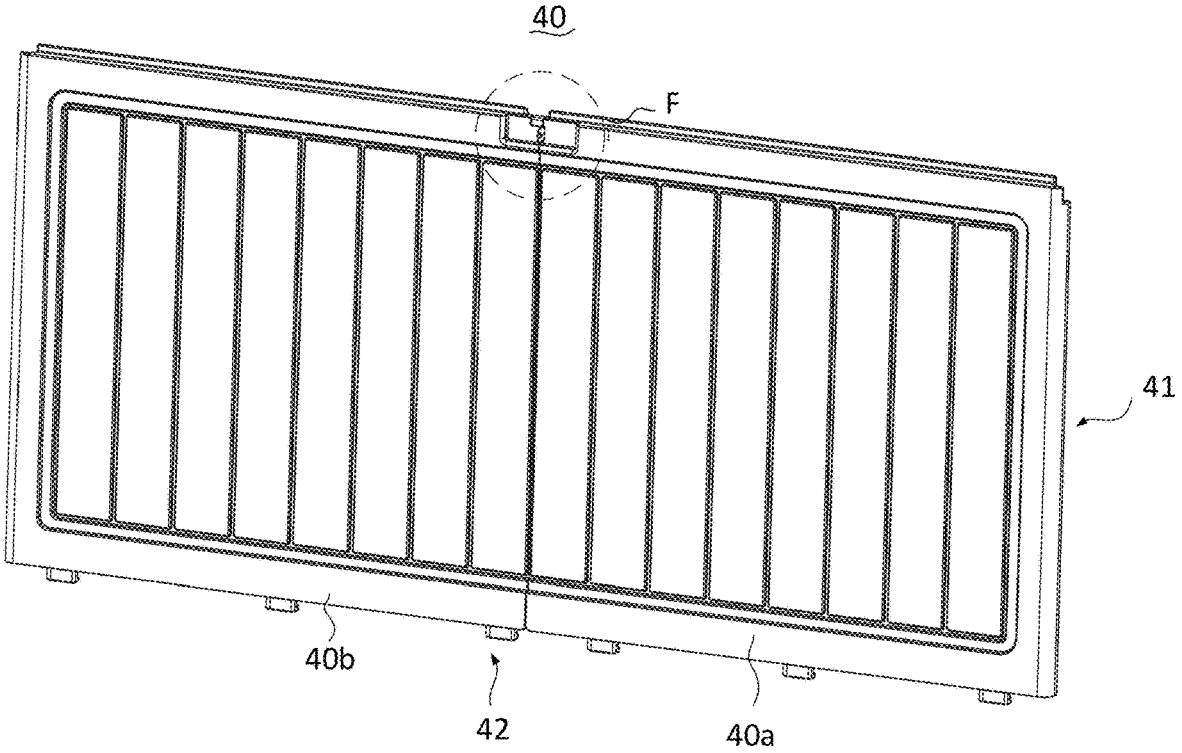
FIG. 12 is a structural schematic diagram of the front plate viewed in a second angle according to one embodiment of the present disclosure.
Figure 13:
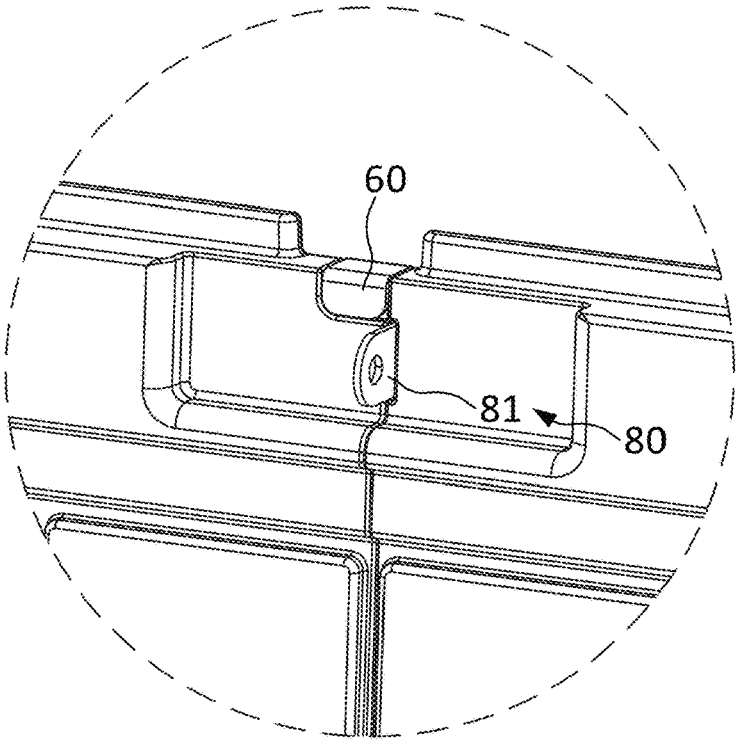
FIG. 13 is a partial enlarged schematic diagram of portion F shown in FIG. 12.

Please refer to FIGS. 10, 12, and 13, in one specific embodiment, the storage box further includes an assembling component 60, the assembling component 60 includes at least two first connecting holes, the first front plate 40*a* includes at least one second connecting hole, and the second front plate 40*b* includes at least one third connecting hole. The at least one second connecting hole and the at least one third connecting hole are respectively fixed with respect to the at least two first connecting holes to fix the first front plate 40*a* with respect to the second front plate 40*b*. The at least two first connecting holes, the at least one second connecting hole, and the at least one third connecting hole are mounted and matched through the threaded fasteners, such as the screws and the bolts, so that connection stability between the first front plate 40*a* and the second front plate 40*b* is improved. Certainly, in other embodiments, the assembling component 60 is a buckling component, slots are respectively defined on the first front plate 40*a* and the second front plate 40*b*, the buckling component is clamped in the slots, so as to improve the connection stability of between the first front plate 40*a* and the second front plate 40*b*.

Please refer to FIG. 3, in one specific embodiment, the rear plate 50 includes a first rear plate 50*a* and a second rear plate 50*b*, the first rear plate 50*a* and the second rear plate 50*b* are sequentially disposed in the length direction Y-Y of the storage box 1, a third one of the second clamping structures 41 is disposed at a first side of the first rear plate 50*a* away from the second rear plate 50*b*, and a fourth one of the second clamping structures 41 is disposed at a first side of the second rear plate 50*b* away from the first rear plate 50*a*. A third assembling portion 51 is disposed at a second side of the first rear plate 50*a* close to the second rear plate 50*b*, a fourth assembling portion 52 is disposed at a second side of the second rear plate 50*b* close to the first rear plate 50*a*, the third assembling portion 51 is fixed with the fourth assembling portion 52 to fix the first rear plate 50*b* with respect to the second rear plate 50*a*. In one embodiment, the third assembling portion 51 and the fourth assembling portion 52 are respectively selected from the buckling portions and the buckling grooves, each buckling portion and the corresponding buckling groove are fixed into a whole; in another embodiment, the third assembling portion 51 and the fourth assembling portion 52 are respectively selected from the positioning portions and the positioning grooves, after each positioning portion is positioned with respect to the corresponding positioning groove, each positioning portion is fixed with respect to the corresponding positioning groove through the threaded fasteners, such as the bolts and the screws. Specific forms and connection forms of the third assembling portion 51 and the fourth assembling portion 52 are not limited in the present disclosure.

Please refer to FIGS. 2-3, in one specific embodiment, the top plate 20 includes a first top plate 20*a*, a second top plate 20*b*, and a first fixing frame 210. The first top plate 20*a* is fixed with respect to the second top plate 20*b* through the first fixing frame 210 in the length direction Y-Y of the storage box 1. In one embodiment, the first fixing frame 210 is fixed with respect to the first top plate 20*a* and the second top plate 20*b* through the threaded fasteners, such as the bolts and the screws.

Furthermore, the first top plate includes a seventh assembling portion 23, the second top plate 20*b* includes an eighth assembling portion 24, the seventh assembling portion 23 and the eighth assembling portion 24 are fixedly connected to fix the first top plate 20*a* with respect to the second top plate 20*b*. In one embodiment, the seventh assembling portion 23 and the eighth assembling portion 24 are respectively selected from the buckling portions and the buckling grooves, each buckling portion and the corresponding buckling groove are fixed into a whole; in another embodiment, the seventh assembling portion 23 and the eighth assembling portion 24 are respectively selected from the positioning portions and the positioning grooves, after each positioning portion is positioned with respect to the corresponding positioning groove, each positioning portion is fixed with respect to the corresponding positioning groove through the threaded fasteners, such as the bolts and the screws. Specific forms and connection forms of the seventh assembling portion 23 and the eighth assembling portion 24 are not limited in the present disclosure.

In order to be convenient for mounting and fixing the first fixing frame 210, first fixing grooves are respectively defined on the first top plate 20*a* and the second top plate 20*b*, the first fixing frame 210 is embedded in the first fixing grooves. In this way, a stress area between the first fixing frame 210 and the two of the first top plate 20*a* and the second top plate 20*b* is increased, stability of the first fixing frame 210 for fixing the first top plate 20*a* and the second top plate 20*b* is further improved, and the first fixing frame 210 is mounted in a hidden manner, a mounting space thereof is reduced. In one embodiment, the first fixing grooves are respectively defined on a bottom surface of the first top plate 20*a* and a bottom surface of the second top plate 20*b*.

Please refer to FIGS. 2-3, in one specific embodiment, the first fixing frame 210 includes at least one first fixing rod, a first end of the at least one first fixing rod is fixedly connected to the first top plate 20*a*, and a second end of the at least one first fixing rod is fixedly connected to the second top plate 20*b*. In this way, the first fixing frame 210 is simple in structure and convenient in assembly. In one embodiment, two first fixing rods are provided, the two first fixing rods are disposed in parallel in the width direction X-X of the storage box 1, so as to improve stability of the two first fixing rods for fixing the first top plate 20*a* and the second top plate 20*b*. Certainly, in other embodiments, one or more first fixing rods are provided, which is not limited in the present disclosure.

Please refer to FIGS. 2-3, in another specific embodiment, the first fixing frame 210 further includes at least two second fixing rods, two first fixing rods are provided, the two first fixing rods are disposed in parallel in the length direction Y-Y of the storage box 1. For example, four second fixing rods are disposed in parallel in the width direction X-X of the storage box 1, and the four second fixing rods are respectively connected to the at least two first fixing rods. In one embodiment of the present disclosure, the first fixing frame 210 includes two first fixing rods and two second fixing rods, and the two first fixing rods and the two second fixing rods are sequentially connected end to end to form a closed frame. Such frame structure is capable of uniformly distributing a force borne on an overall structure thereof, thereby avoiding structural damage caused by excessive pressure on a local point. Such balanced bearing capacity enables the storage box 1 to safely carry more heavy articles, thereby increasing a service life and stability of the storage box 1. Further, in some other embodiments, the first fixing frame includes more than two first fixing rods and more than two second fixing rods, which is not limited in the present disclosure.

Figure 14:
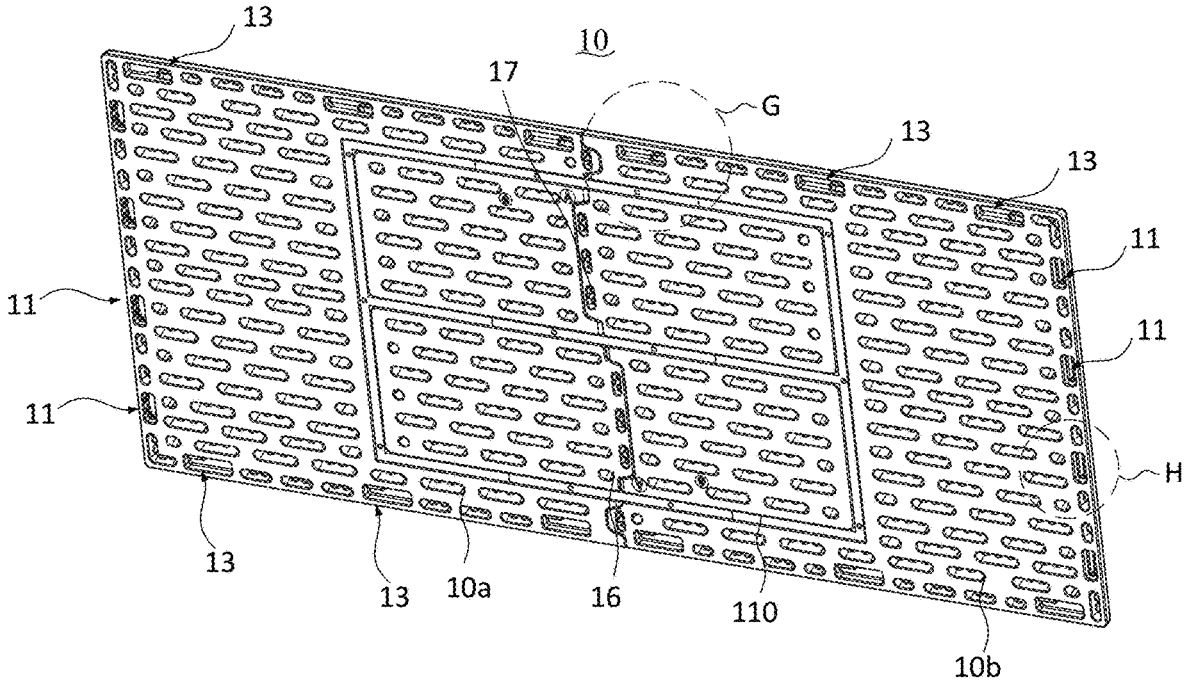
FIG. 14 is a structural schematic diagram of a bottom plate according to one embodiment of the present disclosure.

Please refer to FIG. 14, in one specific embodiment, the bottom plate 10 includes a first bottom plate 10*a*, a second bottom plate 10*b*, and a second fixing frame 110, the first bottom plate 10*a* is fixed with respect the second bottom plate 10*b* in the length direction Y-Y of the storage box 1. The second fixing frame 110 includes at least one first connecting rod, a first end of the at least one first connecting rod is fixedly connected to the first bottom plate 10*a*, and a second end of the at least one first connecting rod is fixedly connected to the second bottom plate 10*b*. The second fixing frame 110 further comprises at least two second connecting rods, the at least two second connecting rods extend in the width direction X-X of the storage box 1. A specific form and a mounting form of the second fixing frame 110 of the present disclosure may refer to a specific form and amounting form of the first fixing frame 210 as foregoing.

In one embodiment, second fixing grooves are respectively defined on the first bottom plate 10*a* and the second bottom plate 10*b*, the second fixing frame is embedded in the second fixing grooves. In this way, a stress area between the second fixing frame 110 and the two of the first bottom plate 10*a* and the second bottom plate 10*b* is increased, stability of the second fixing frame 110 for fixing the first top plate 10*a* and the second bottom plate 10*b* is further improved, and the second fixing frame 110 is mounted in the hidden manner, a mounting space thereof is reduced. In one embodiment, the second fixing grooves are respectively defined on a bottom surface of the first bottom plate 10*a* and a top surface of the second top plate 10*b*.

Please refer to FIGS. 2, 3, and 14, the first bottom plate 10*a* comprises a fifth assembling portion 16, the second bottom plate 10*b* includes a sixth assembling portion 17, the fifth assembling portion 16 and the sixth assembling portion 17 are fixedly connected to fix the first bottom plate 10*a* with respect to the second bottom plate 10*b*. In one embodiment, the fifth assembling portion 16 and the sixth assembling portion 17 are respectively selected from the buckling portions and the buckling grooves, each buckling portion and the corresponding buckling groove are fixed into a whole; in another embodiment, the fifth assembling portion 16 and the sixth assembling portion 17 are respectively selected from the positioning portions and the positioning grooves, after each positioning portion is positioned with respect to the corresponding positioning groove, each positioning portion is fixed with respect to the corresponding positioning groove through the threaded fasteners, such as the bolts and the screws. Specific forms and connection forms of the fifth assembling portion 16 and the sixth assembling portion 17 are not limited in the present disclosure.

Figure 18:
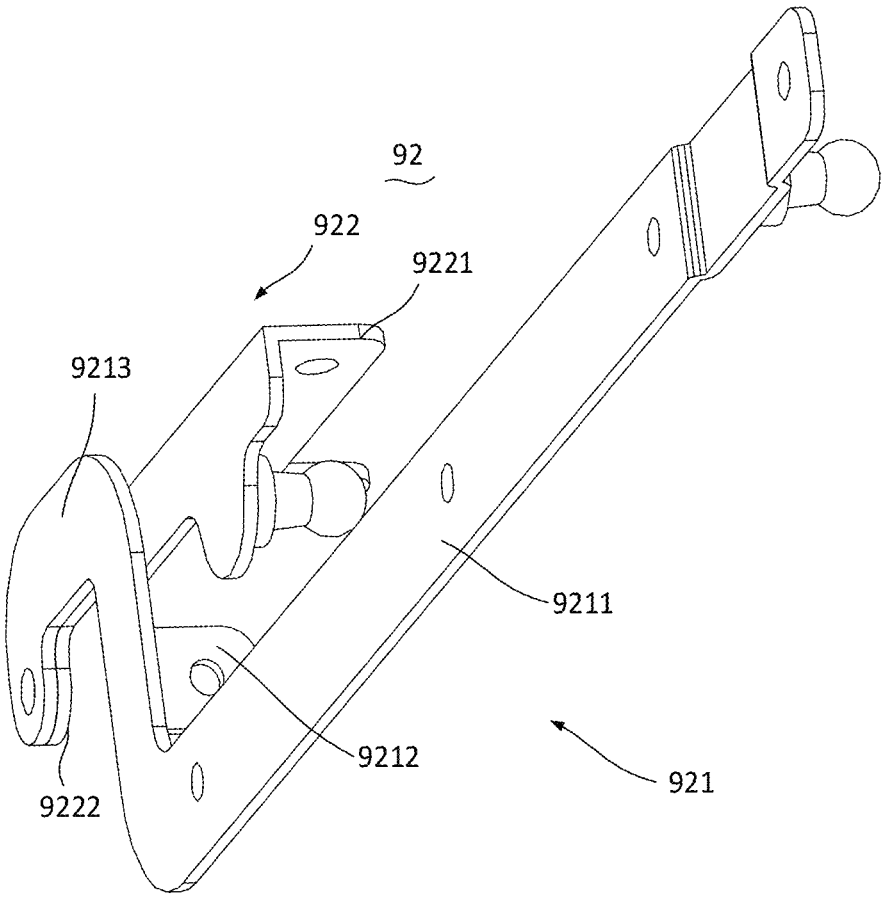
FIG. 18 is a structural schematic diagram of an assembling component according to one embodiment of the present disclosure.

Please refer to FIG. 18, in one specific embodiment, the storage box 1 includes at least one fixing assembly 92, the fixing assembly 92 includes a first fixing component 921 and a second fixing component 922, the first fixing component 921 include a first fixing portion 9211, a second fixing portion 9212, and a third fixing portion 9212, the first fixing portion 9211 is fixedly connected to one of the two side plates 30, the second fixing portion 9212 is fixedly connected to the rear plate 50, one end of the third fixing portion 9213 extends to a rear side of the rear plate 50 and includes a first fixing hole 9214. The second fixing component 922 includes a fourth fixing portion 9221 and a fifth fixing portion 9222, the fourth fixing portion 9221 is fixedly connected to one of the two side plates 20, one end of the fifth fixing portion 9222 extends to the rear side of the rear plate 50 and includes a second fixing hole 9223. The first fixing hole 9214 and the second fixing hole 9223 are fixed to fix the top plate 20 and the one of the two side plates 30 with the rear plate 50.

The first fixing portion 9211, the second fixing portion 9212, the third fixing portion 9213, the fourth fixing portion 9221, and the fifth fixing portion 9222 are of a plate structure. A connection manner between the first fixing portion 9211 and a corresponding one of the two side plates 30 and a connection manner between the second fixing portion 9212 and the rear plate 50 are both manners of mutually fixing and matching through the threaded fasteners. In this way, stability of fixing the first fixing component 921 with the corresponding of the two side plates 30 and the rear plate 50 is improved. Specifically, the fourth fixing portion 9221 is fixedly connected to the first fixing frame 210, so as to improve fixing stability between the second fixing component 922 and the top plate 20. When the top plate 20 covers a box body of the storage box 1, the first fixing hole 9214 is fixedly matched with the second fixing hole 9223 through fasteners, such as screws and bolts, so as to improve stability of fixing the top plate 20 with respect to the two side plates 30 and the rear plate 50.

Please refer to FIGS. 2-3, in one specific embodiment, the first fixing portion 9211 and the second fixing portion 9212 are respectively connected to an inner side surface of the corresponding one of the two side plates 30 and the rear plate 50, the fourth fixing portion is connected to a bottom surface of the top plate 20. Both the third fixing portion 9213 and the fifth fixing portion 9222 are hooking bodies and are mounted at a top portion of the rear plate 50, at least one second limiting groove is defined on a bottom surface of the top plate 20 for matching with the third fixing portion 9213 and the fifth fixing portion 9222. In this way, the fixing assembly 92 mounted in the hidden manner and the third fixing portion 9213 and the fifth fixing portion 9222 are capable of conveniently extending out from the storage space.

Please refer to FIGS. 2-3, in one specific embodiment, the storage box 1 includes at least one blocking plate 91, the at least one blocking plate 91 is detachably disposed in the storage space to divide the storage space into at least two sub-storage cavities. The at least one blocking plate 91 extends in the length direction Y-Y of the storage box 1, or extends in the width direction X-X of the storage box 1. For example, the at least one blocking plate 91 91 extends in the width direction X-X of the storage box 1 to space the storage space in to the at least two sub-storage cavities in the length direction Y-Y of the storage box 1. In the embodiment, limitation mounting grooves are respectively defined on an inner side surface of the front plate 40 and an inner side surface of the rear plate 50, and two opposite sides of the at least one blocking plate 91 are inserted into the limitation mounting grooves to fix in the storage space.

Figure 19:
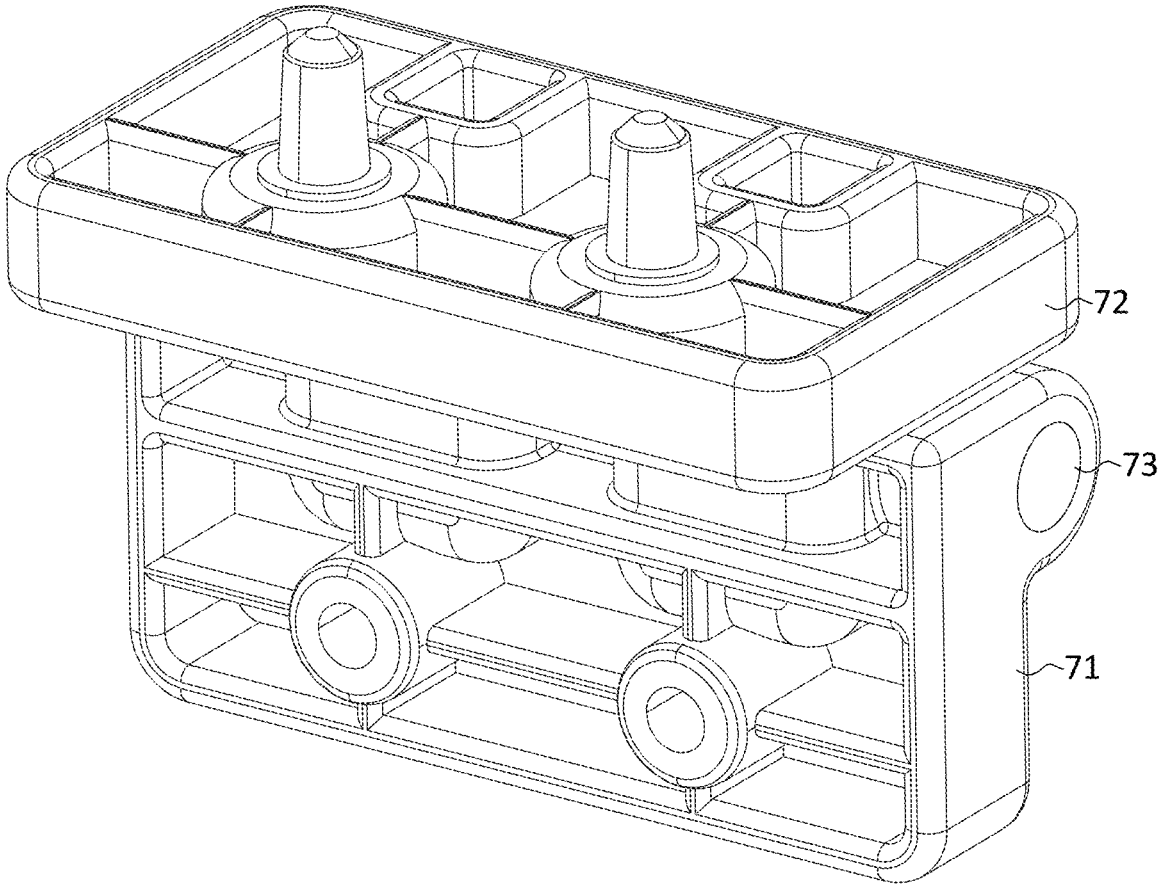
FIG. 19 is a structural schematic diagram of a rotating assembly according to one embodiment of the present disclosure.
Figure 20:
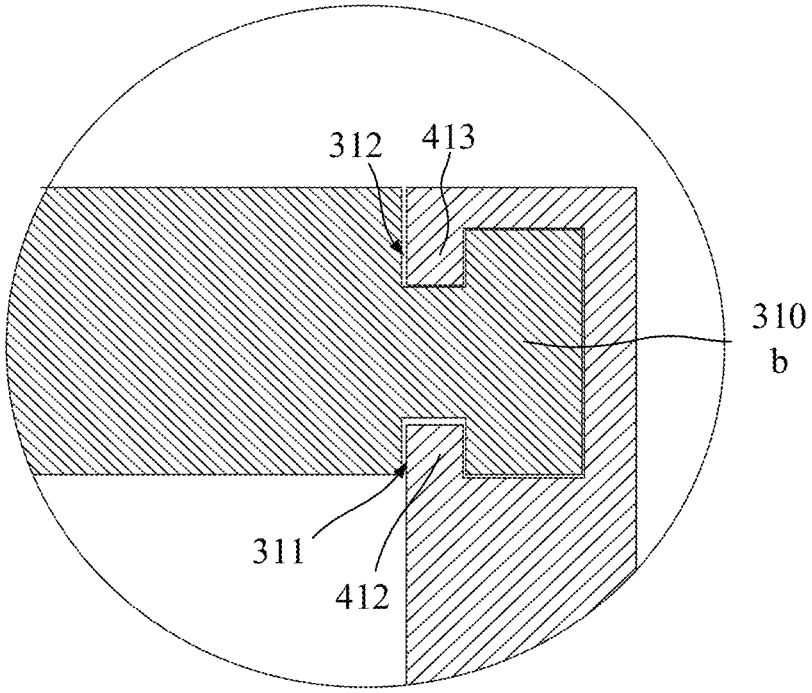
FIG. 20 is a partial cross-sectional schematic diagram of a first clamping structure assembling with a second clamping structure.
Figure 21:
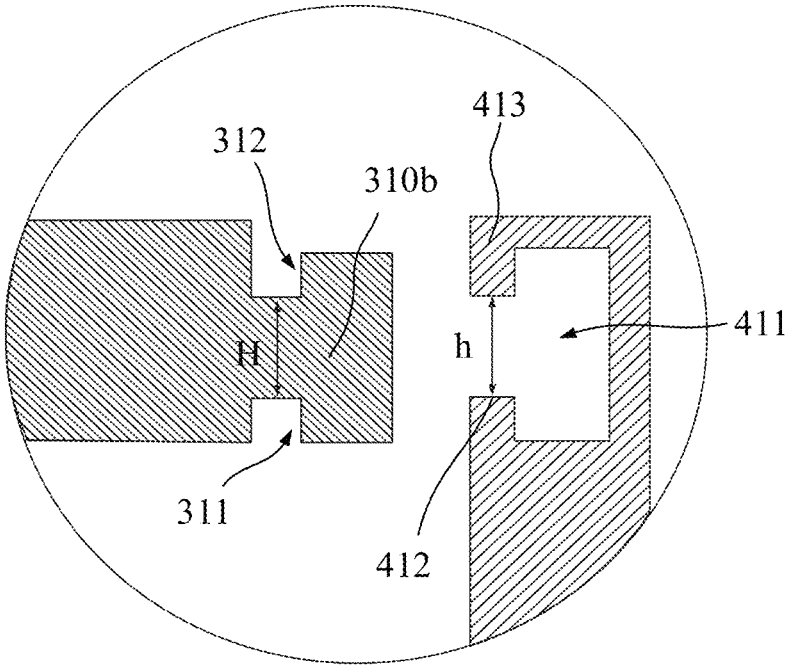
FIG. 21 is a partial cross-sectional schematic diagram of the first clamping structure separating from the second clamping structure.

Please refer to FIG. 19, in one specific embodiment, the storage box 1 further includes at least one rotating assembly 70, the rotating assembly 70 includes a first connecting component 71, a second connecting component 72, and a rotating shaft 73, the first connecting component 71 rotates with respect to the second connecting component 72 through the rotating shaft 73, the first connecting component 71 is fixedly connected to the rear plate 50, and the second connecting component 72 is connected to the top plate 20. In this way, a rear side of the top plate 20 is rotatably connected to the top portion of the rear plate 50, so that flipping the top plate 20 upward may open the storage space, and the operation is simple. A connection manner between the first connecting component 71 and the rear plate 50 and a connection manner between the second connecting component 72 and the top plate 20 may be in a form of screwing, clamping, etc.

Please refer to FIGS. 12 and 18, in one specific embodiment, the storage box 1 further includes a locking structure 80, the locking structure 80 includes a third connecting component 81 and a fourth connecting component 82, the third connecting component 81 includes a first connecting portion and a second connecting portion, the first connecting portion is connected with the second connecting portion, and the fourth connecting component 82 comprises a third connecting portion and a fourth connecting portion, and the third connecting portion is connected with the fourth connecting portion. The second connecting portion defines a first connecting hole, and the fourth connecting portion defines a second connecting hole. Specifically, when assembling, the first connecting portion is fixedly connected to the top plate 20, the third connecting portion is fixedly connected to the front plate 40, at this time, the first connecting hole of the second connecting portion is aligned with the second connecting hole of the fourth connecting portion, and the first connecting hole and the second connecting hole are capable being fixed through components, such as a lock, so as to fix the top plate 20 with respect to the front plate 40, thereby avoiding a situation that articles stored in the storage box 1 falls out due to a fact that the top plate 20 is turned over in a transportation process. Certainly, a benefit is that the lock further protects the articles stored in the storage box 1 and prevents the articles stored in the storage box 1 from being lost.

In one specific embodiment, second limiting portions are respectively disposed on top portions of the two side plates 30, a top portion of the front plate 40, and the top portion of the rear plate 50, annular limiting portions protruding downwards are disposed at an edge of the bottom portion of the top plate 20, top portions of the second limiting portions abut against the bottom portion of the top plate 20, and outer side surfaces of the second limiting portions respectively abut against inner side surfaces of the annular limiting portions. In this way, stability of fixing the top plate 20, the two side plates 30, the front plate 40, and the rear plate 50 with respect to each other when the top plate 20 covers an opening of the storage box 1 is improved, and waterproof is further achieved.

Based on above embodiments, in the present disclosure, the bottom plate 10, the top plate 20, the front plate 40, and the rear plate 50 are all divided into at least two plate bodies, in this way, a packaging space of the storage box 1 is reduced while the storage space of the storage box 1 is increased, which is convenient for transportation. Moreover, mounting the plurality of plate bodies in the structural form of the present disclosure is capable of maintaining a structural strength of the storage box 1, thereby better meeting user requirements.

Same or similar reference numerals in the drawings of the embodiments of the present disclosure correspond to the same or similar components. In the description of the present disclosure, it should be understood that orientations or working position relationships indicated by terms "upper", "lower", "left", "right", etc. are only for ease of description of the present disclosure and simplified description, rather than indicating or implying that the referred device or element must have a specific orientation, and is constructed and operated in a specific orientation, so the terms describing the working position relationships in the accompanying drawings are only used for exemplary description and cannot be understood as a limitation to the present disclosure, and for those who skilled in the art, specific meanings of above terms may be understood according to specific situations.

The above are only preferred embodiments of the present disclosure and are not intended to limit the present disclosure, and any modification, equivalent replacement and improvement made within a spirit and a principle of the present disclosure shall fall within a protection scope of the present disclosure.

What is claimed is:

1. A storage box, comprising:

a bottom plate;

a top plate;

two side plates;

a front plate; and a rear plate;

wherein the bottom plate, the top plate, the two side plates, the front plate, and the rear plate are detachably connected to each other;

the bottom plate and the top plate are disposed in parallel in a height direction of the storage box, the two side plates, the front plate, and the rear plate are disposed between the bottom plate and the top plate to enclose to form a storage space;

first clamping structures are respectively disposed at two opposite sides of each of the two side plates, and second clamping structures are respectively disposed at two opposite sides of each of the front plate and the rear plate;

the first clamping structures and the second clamping structures all extend in the height direction of the storage box, the first clamping structures are respectively clamped with the second clamping structures to fix the two side plates with respect to the front plate and the rear plate;

the top plate comprises a first top plate, a second top plate, and a first fixing frame;

the first fixing frame comprises at least one first fixing rod, a first end of the at least one first fixing rod is fixedly connected to the first top plate, and a second end of the at least one first fixing rod is fixedly connected to the second top plate;

the bottom plate comprises a first bottom plate, a second bottom plate, and a second fixing frame, the second fixing frame comprises at least one first connecting rod, a first end of the at least one first connecting rod is fixedly connected to the first bottom plate, and a second end of the at least one first connecting rod is fixedly connected to the second bottom plate;

first fixing grooves are respectively defined on the first top plate and the second top plate, the first fixing frame is embedded in the first fixing grooves; and second fixing grooves are respectively defined on the first bottom plate and the second bottom plate, the second fixing frame is embedded in the second fixing grooves.

2. The storage box according to claim 1, wherein each of the first clamping structures comprises an edge portion of a corresponding one of the two side plates, a first clamping groove, and a second clamping groove, each first clamping groove is recessed from an inner side surface of the corresponding one of the two side plates, and each second clamping groove is recessed from an outer side surface of the corresponding one of the two side plates;

each of the second clamping structures comprise a third clamping groove, a first clamping protrusion, and a second clamping protrusion, each third clamping groove is recessed from an inner side surface of a corresponding one of the front plate and the rear plate, and each first clamping protrusion and each second clamping protrusion are disposed in a corresponding third clamping groove; and the edge portion of the corresponding one of the two side plates is clamped in the corresponding third clamping groove, each first clamping protrusion is clamped in a corresponding first clamping groove, and each second clamping protrusion is clamped in a corresponding second camping groove.

3. The storage box according to claim 2, wherein each first clamping groove is aligned with a corresponding second clamping groove in a length direction of the storage box; and/or a distance between each first clamping protrusion and a corresponding second clamping protrusion is smaller than a thickness of each of the two side plates.

4. The storage box according to claim 1, wherein each of the first clamping structures comprises at least two third clamping protrusions, the at least two third clamping protrusions are connected to an edge portion of a corresponding one of the two side plates and are disposed at a first included angle; and each of the second clamping structures comprises at least two fourth clamping grooves, each at least two fourth clamping grooves are respectively matched with outer contours of corresponding at least two third clamping protrusions, the corresponding at least two third clamping protrusions are respectively clamped in corresponding at least two fourth clamping grooves.

5. The storage box according to claim 4, wherein each at least two third clamping protrusions are respectively connected at two sides of the edge portion of the corresponding one of the two side plates in a length direction of the storage box and are aligned in a width direction of the storage box.

6. The storage box according to claim 1, wherein each of the two side plates comprises a first limiting portion disposed on a top portion of a corresponding one of the first clamping structures, each of the front plate and the rear plate comprises a first limiting groove defined on a top portion of a corresponding one of the second clamping structures; and each first limiting portion is embedded in a corresponding first limiting groove, and a bottom surface of each first limiting portion abuts against a groove bottom wall of the corresponding first limiting groove.

7. The storage box according to claim 1, wherein each of the two side plates comprises at least one first buckling structure disposed at a bottom portion thereof, each at least one first buckling structure comprises a first base portion and a first hook portion, each first hook portion is connected to one side of a corresponding first base portion;

the bottom plate comprises at least two first buckling grooves, each of the at least two first buckling grooves comprises a first clamping portion on a groove side wall thereof; and each first base portion is clamped in a corresponding one of the at least two first buckling grooves and each first hook portion is clamped to a corresponding first clamping portion to fix a corresponding one of the two side plates with the bottom plate in the height direction of the storage box.

8. The storage box according to claim 1, wherein each of the front plate and the rear plate comprises at least one second buckling structure disposed at a bottom portion thereof, each at least one second buckling structure comprises a second base portion, each second base portion comprises a second buckling groove, and a second hook portion is disposed on a groove side wall of each second buckling groove;

the bottom plate comprises at least two third buckling structures, each of the at least two third buckling structures comprises a third buckling groove and a second clamping portion, each third buckling groove is defined at an edge of the bottom plate, each second clamping portion is connected to a groove side wall of a corresponding third buckling groove, each second clamping portion comprises a hooking groove for matching with a corresponding second hook portion; and each second base portion is clamped in the corresponding third buckling groove and each second hook portion is clamped to a corresponding hooking groove to fix a corresponding one of the front plate and the rear plate with the bottom plate.

9. The storage box according to claim 1, wherein the front plate comprises a first front plate and a second front plate, the first front plate and the second front plate are sequentially disposed in a length direction of the storage box, a first one of the second clamping structures is disposed at a first side of the first front plate away from the second front plate, and a second one of the second clamping structures is disposed at a first side of the second front plate away from the first front plate; and a first assembling portion is disposed at a second side of the first front plate close to the second front plate, a second assembling portion is disposed at a second side of the second front plate close to the first front plate, the first assembling portion is fixed with the second assembling portion to fix the first front plate with respect to the second front plate.

10. The storage box according to claim 9, wherein the storage box further comprises an assembling component, the assembling component comprises at least two first connecting holes, the first front plate comprises at least one second connecting hole, and the second front plate comprises at least one third connecting hole; and the at least one second connecting hole and the at least one third connecting hole are respectively fixed with respect to the at least two first connecting holes to fix the first front plate with respect to the second front plate.

11. The storage box according to claim 1, wherein the rear plate comprises a first rear plate and a second rear plate, the first rear plate and the second rear plate are sequentially disposed in a length direction of the storage box, a third one of the second clamping structures is disposed at a first side of the first rear plate away from the second rear plate, and a fourth one of the second clamping structures is disposed at a first side of the second rear plate away from the first rear plate; and a third assembling portion is disposed at a second side of the first rear plate close to the second rear plate, a fourth assembling portion is disposed at a second side of the second rear plate close to the first rear plate, the third assembling portion is fixed with the fourth assembling portion to fix the first rear plate with respect to the second rear plate.

12. The storage box according to claim 1, wherein the first fixing frame further comprises at least two second fixing rods, at least two first fixing rods are provided, the at least two first fixing rods are disposed in parallel in a length direction of the storage box, the at least two second fixing rods are disposed in parallel in a width direction of the storage box, and the at least two second fixing rods are respectively connected to the at least two first fixing rods.

13. The storage box according to claim 1, wherein the second fixing frame further comprises at least two second connecting rods, at least two first connecting rods are provided, the at least two first connecting rods are disposed in parallel in a length direction of the storage box, the at least two second connecting rods are disposed in parallel in a width direction of the storage box, and the at least two second connecting rods are respectively connected to the at least two first connecting rods.

14. The storage box according to claim 1, wherein the first bottom plate comprises a fifth assembling portion, the second bottom plate comprises a sixth assembling portion, the fifth assembling portion and the sixth assembling portion are fixedly connected to fix the first bottom plate with respect to the second bottom plate; and the first top plate comprises a seventh assembling portion, the second top plate comprises an eighth assembling portion, the seventh assembling portion and the eighth assembling portion are fixedly connected to fix the first top plate with respect to the second top plate.

15. The storage box according to claim 1, wherein the storage box further comprises at least one fixing assembly, the fixing assembly comprises a first fixing component and a second fixing component, the first fixing component comprises a first fixing portion, a second fixing portion, and a third fixing portion, the first fixing portion is fixedly connected to one of the two side plates, the second fixing portion is fixedly connected to the rear plate, one end of the third fixing portion extends to a rear side of the rear plate and comprises a first fixing hole;

the second fixing component comprises a fourth fixing portion and a fifth fixing portion, the fourth fixing portion is fixedly connected to one of the two side plates, one end of the fifth fixing portion extends to the rear side of the rear plate and comprises a second fixing hole; and the first fixing hole and the second fixing hole are fixed to fix the top plate and the one of the two side plates with the rear plate.

16. The storage box according to claim 15, wherein both the third fixing portion and the fifth fixing portion are hooking bodies and are mounted at a top portion of the rear plate, at least one second limiting groove is defined on a bottom surface of the top plate for matching with the third fixing portion and the fifth fixing portion.

17. The storage box according to claim 1, wherein the storage box further comprises at least one blocking plate, the at least one blocking plate is detachably disposed in the storage space to divide the storage space into at least two sub-storage cavities; and/or the storage box further comprises at least one rotating assembly, the rotating assembly comprises a first connecting component, a second connecting component, and a rotating shaft, the first connecting component rotates with respect to the second connecting component through the rotating shaft, the first connecting component is connected to the rear plate, and the second connecting component is connected to the top plate.

18. The storage box according to claim 1, wherein the storage box further comprises a locking structure, the locking structure comprises a third connecting component and a fourth connecting component, the third connecting component comprises a first connecting portion and a second connecting portion, the first connecting portion is connected with the second connecting portion, the fourth connecting component comprises a third connecting portion and a fourth connecting portion, and the third connecting portion is connected with the fourth connecting portion; and the first connecting portion and the second connecting portion are disposed a second included angle, the first connecting portion is fixedly connected to a bottom surface of the top plate, the second connecting portion is disposed at a front side of the front plate and defines a first connecting hole;

the third connecting portion and the fourth connecting portion are disposed a third included angle, the third connecting portion is fixedly connected to the top plate, the second connecting portion is disposed at the front side of the front plate and defines a second connecting hole; and the first connecting hole is fixed with the second connecting hole to fix the top plate with respect to the front plate.

19. A storage box, comprising:

a bottom plate;

a top plate;

two side plates;

a front plate; and a rear plate;

wherein the bottom plate, the top plate, the two side plates, the front plate, and the rear plate are detachably connected to each other;

the bottom plate and the top plate are disposed in parallel in a height direction of the storage box, the two side plates, the front plate, and the rear plate are disposed between the bottom plate and the top plate to enclose to form a storage space;

first clamping structures are respectively disposed at two opposite sides of each of the two side plates, and second clamping structures are respectively disposed at two opposite sides of each of the front plate and the rear plate;

the first clamping structures and the second clamping structures all extend in the height direction of the storage box, the first clamping structures are respectively clamped with the second clamping structures to fix the two side plates with respect to the front plate and the rear plate;

the storage box further comprises at least one fixing assembly, the fixing assembly comprises a first fixing component and a second fixing component, the first fixing component comprises a first fixing portion, a second fixing portion, and a third fixing portion, the first fixing portion is fixedly connected to one of the two side plates, the second fixing portion is fixedly connected to the rear plate, one end of the third fixing portion extends to a rear side of the rear plate and comprises a first fixing hole;

the second fixing component comprises a fourth fixing portion and a fifth fixing portion, the fourth fixing portion is fixedly connected to one of the two side plates, one end of the fifth fixing portion extends to the rear side of the rear plate and comprises a second fixing hole; and the first fixing hole and the second fixing hole are fixed to fix the top plate and the one of the two side plates with the rear plate.

20. A storage box, comprising:

a bottom plate;

a top plate;

two side plates;

a front plate; and a rear plate;

wherein the bottom plate, the top plate, the two side plates, the front plate, and the rear plate are detachably connected to each other;

the bottom plate and the top plate are disposed in parallel in a height direction of the storage box, the two side plates, the front plate, and the rear plate are disposed between the bottom plate and the top plate to enclose to form a storage space;

first clamping structures are respectively disposed at two opposite sides of each of the two side plates, and second clamping structures are respectively disposed at two opposite sides of each of the front plate and the rear plate;

the first clamping structures and the second clamping structures all extend in the height direction of the storage box, the first clamping structures are respectively clamped with the second clamping structures to fix the two side plates with respect to the front plate and the rear plate;

the storage box further comprises a locking structure, the locking structure comprises a third connecting component and a fourth connecting component, the third connecting component comprises a first connecting portion and a second connecting portion, the first connecting portion is connected with the second connecting portion, the fourth connecting component comprises a third connecting portion and a fourth connecting portion, and the third connecting portion is connected with the fourth connecting portion; and the first connecting portion and the second connecting portion are disposed a second included angle, the first connecting portion is fixedly connected to a bottom surface of the top plate, the second connecting portion is disposed at a front side of the front plate and defines a first connecting hole;

the third connecting portion and the fourth connecting portion are disposed a third included angle, the third connecting portion is fixedly connected to the top plate, the second connecting portion is disposed at the front side of the front plate and defines a second connecting hole; and the first connecting hole is fixed with the second connecting hole to fix the top plate with respect to the front plate.

* * * * *